United States Patent [19]

Lineback

[11] Patent Number: 4,562,784

[45] **Date of Patent: * Jan. 7, 1986**

[54] SAILING CRAFT

[75] Inventor: Donald R. Lineback, Ellsworth, Kans.

[73] Assignee: Linecat Industries, Inc., Ellsworth, Kans.

[ * ] Notice: The portion of the term of this patent subsequent to Aug. 7, 2001 has been disclaimed.

[21] Appl. No.: 630,851

[22] Filed: Jul. 13, 1984

Related U.S. Application Data

[63] Continuation of Ser. No. 278,095, Jun. 28, 1981, Pat. No. 4,463,699.

[51] Int. Cl.[4] ..... B63H 9/00

[52] U.S. Cl. ..... 114/39; 24/122.6; 24/136 R; 114/56; 114/61; 114/91; 114/102; 114/140; 114/162; 114/163; 114/165; 114/218

[58] Field of Search ..... 114/39, 61, 56, 67 A, 114/90, 91, 102, 103, 108, 109, 140, 162, 163, 165, 218; 24/130, 122.6, 115 M, 136 R

[56] References Cited

U.S. PATENT DOCUMENTS

| | | | |
|---|---|---|---|
| 779,961 | 1/1905 | Nicholson | 114/162 |
| 1,613,890 | 1/1927 | Herreshoff | 114/39 |
| 2,991,749 | 7/1961 | Patterson | 114/162 X |
| 3,574,900 | 4/1971 | Emery | 114/218 X |
| 3,931,779 | 1/1976 | Kreuger | 114/39 |
| 3,988,810 | 11/1976 | Emery | 24/130 |
| 4,463,699 | 8/1984 | Lineback | 114/56 |

*Primary Examiner*—Sherman D. Basinger
*Attorney, Agent, or Firm*—Gary L. Jordan

[57] ABSTRACT

A sailing craft having hydrodynamically shaped catamaran hulls and tapered configuration rudder assemblies attached to each hull. Low draft keels are attached to the fore one-half bottom portions of the hull and a pitch-sensitive variable camber mast and main sail assembly is rotatably mounted on a cross-beam framework which interconnects the two hulls. The mast is constructed and rigged to bow with respect to the longitudinal plane of the sailing craft which passes through the roll axis in response to a high velocity wind force. The bow decreases as the wind velocity decreases and the mast rotates to form a camber adjustment through use of battens attached to the main sail sheet(s). The rudder assembly and control bungy cords and lines permit selective raising and lowering and automatic raising upon contact with underwater obstacles. The deck structure provides for quick dismantling and ease of sailing. Novel shroud line cleats are incorporated into the rigging and the hull has a textured surface which promotes wetting by water for higher sailing speeds.

11 Claims, 90 Drawing Figures

Hull motion
WATER
45°
10°
30°
60°
120°

FIG.8
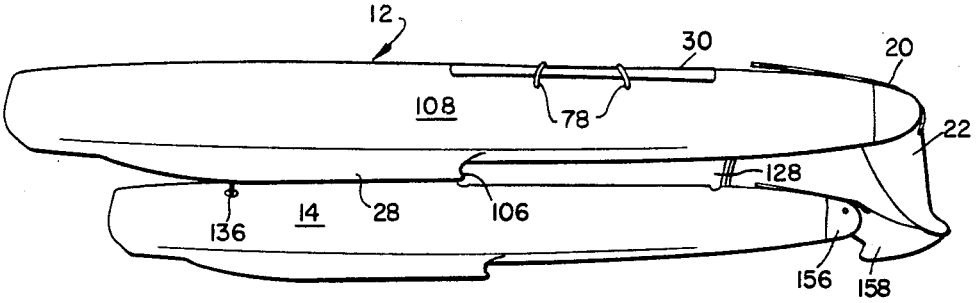
FIG.9.
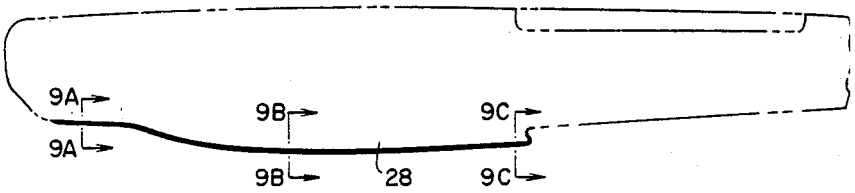
FIG.9C.
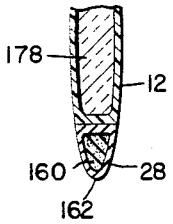
FIG. 9E
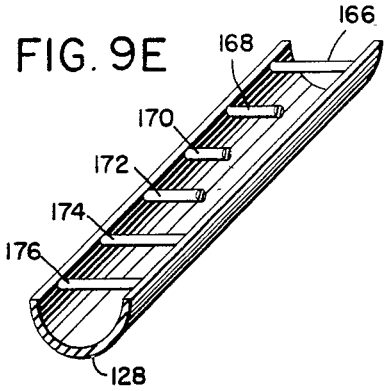
FIG.9B
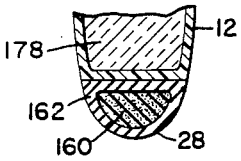
FIG. 9D
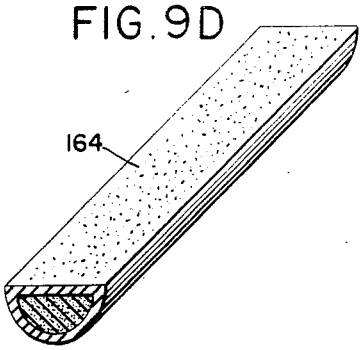
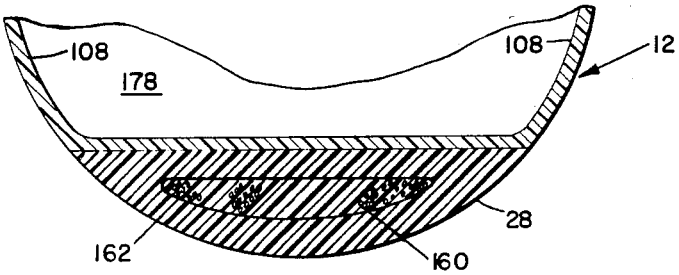
FIG.9A FIG. 10B
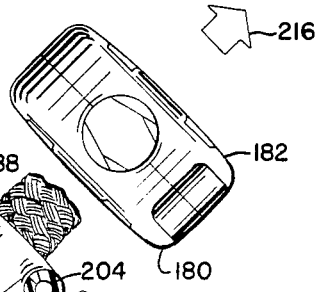
FIG. 10C
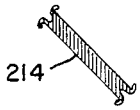
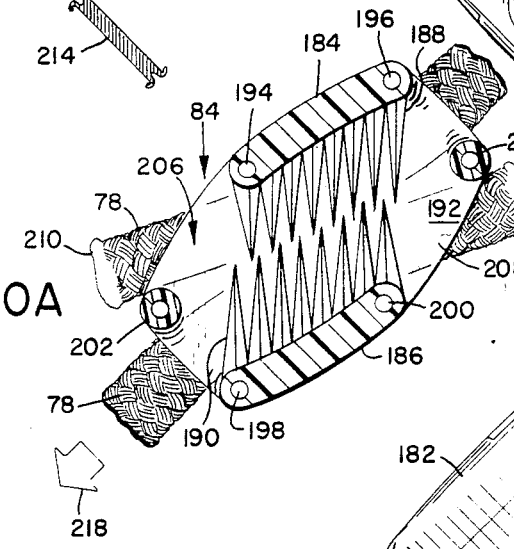
FIG. 10A
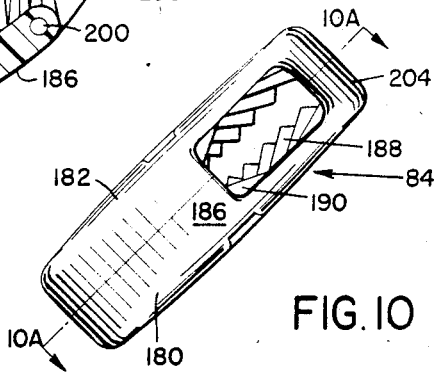
FIG. 10

FIG. 12
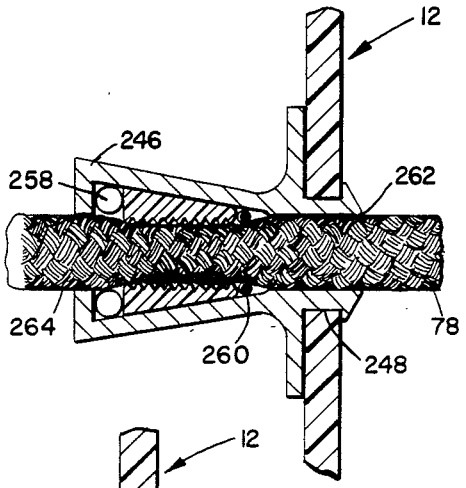
FIG. 12A
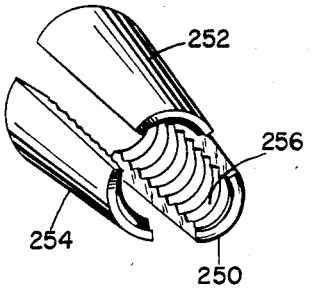
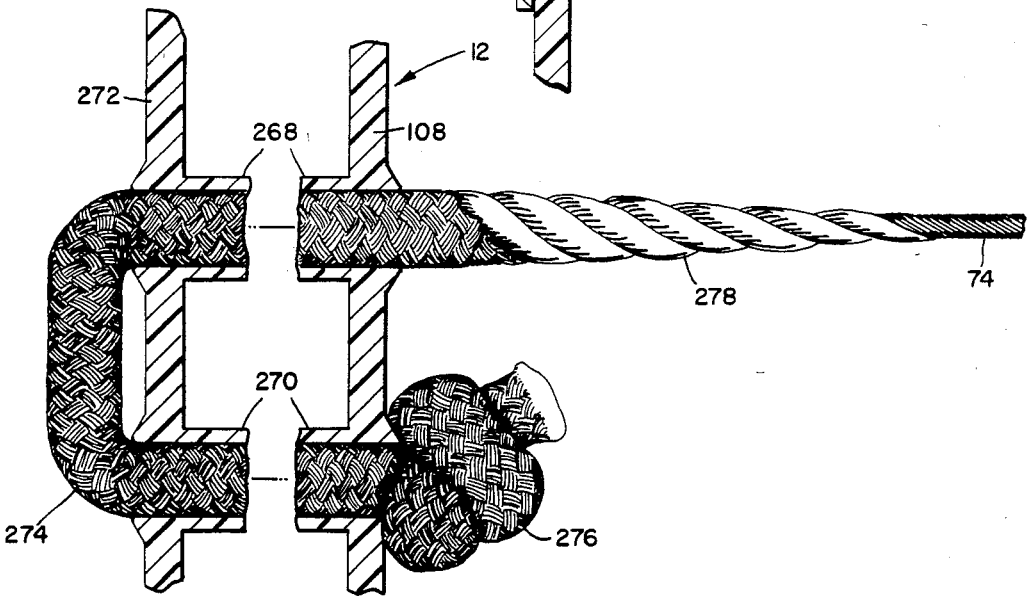
FIG. 13.

FIG. 15A
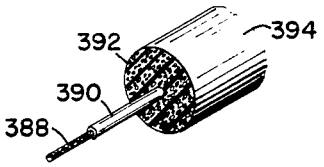
FIG. 15B
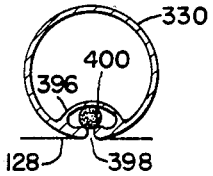
FIG. 18A
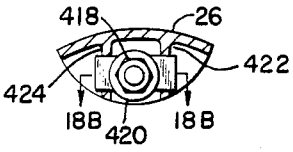
FIG. 18B
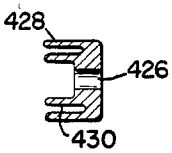
FIG. 15C
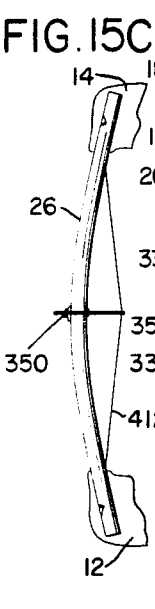
FIG. 15.
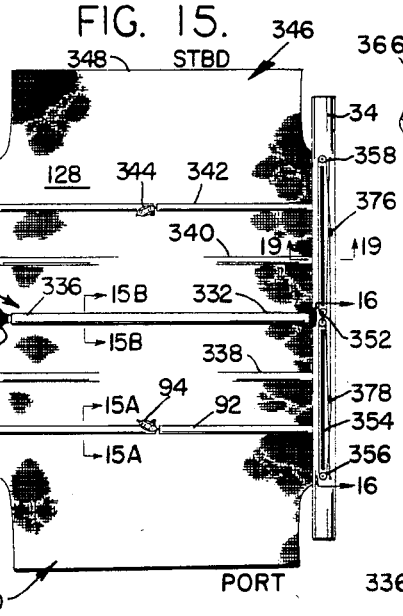
FIG. 16.
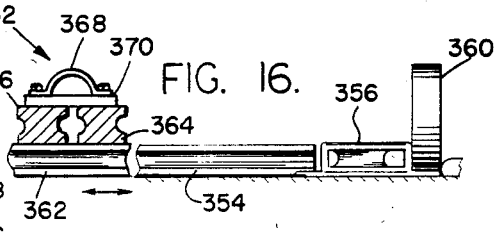
FIG. 17A
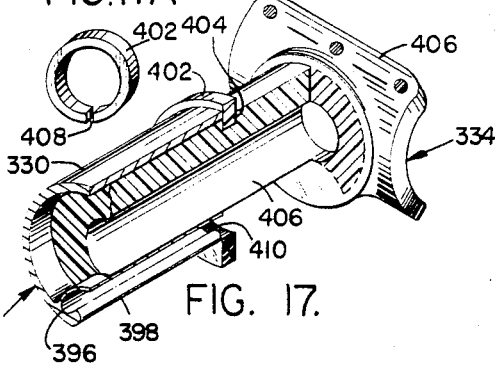
FIG. 17.
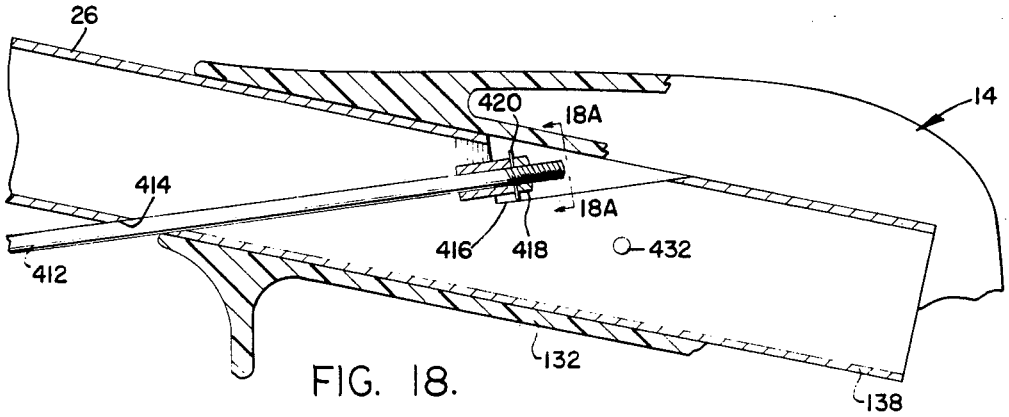
FIG. 18.

FIG. 19A
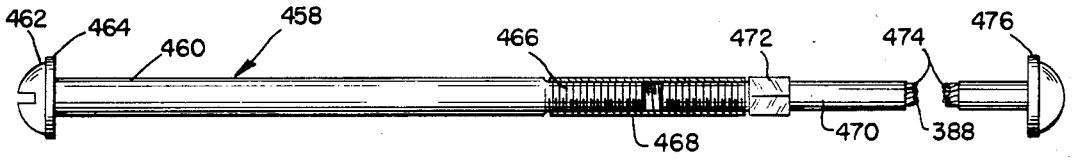
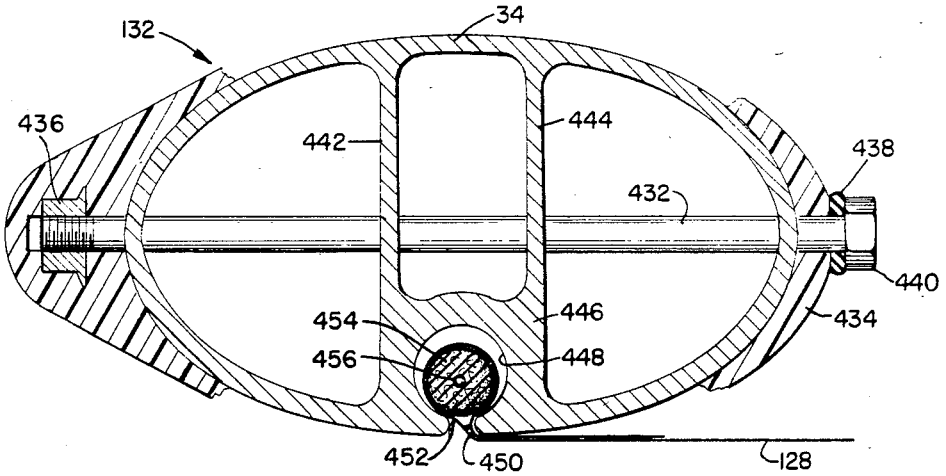
FIG. 19.

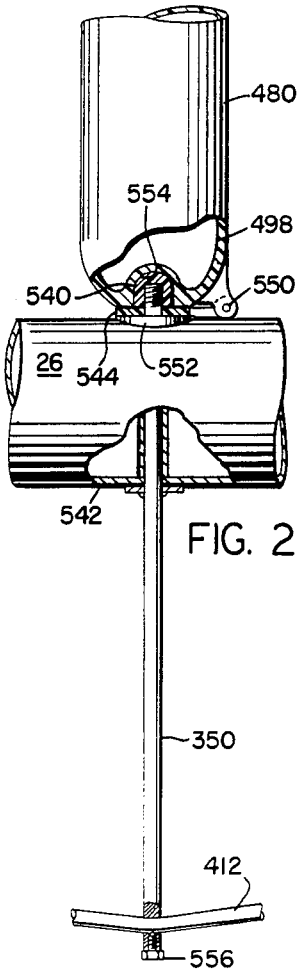
FIG. 23.
FIG. 23A
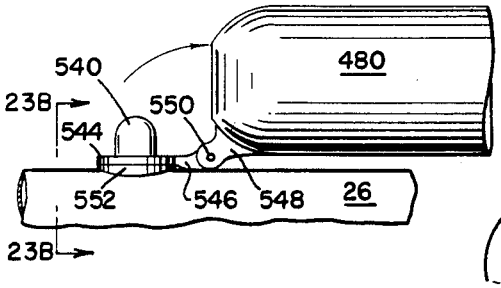
FIG. 23B
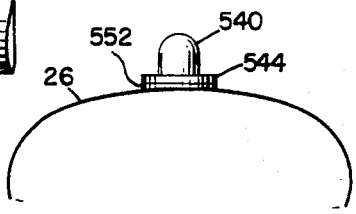
FIG. 25
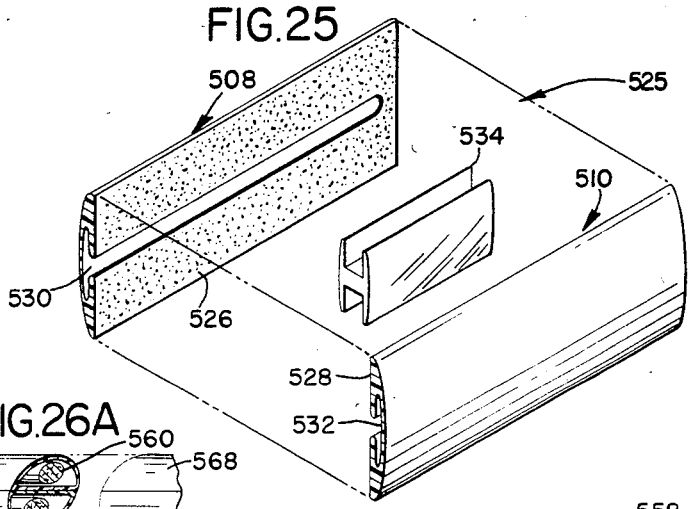
FIG. 26A
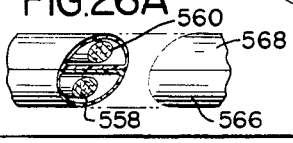
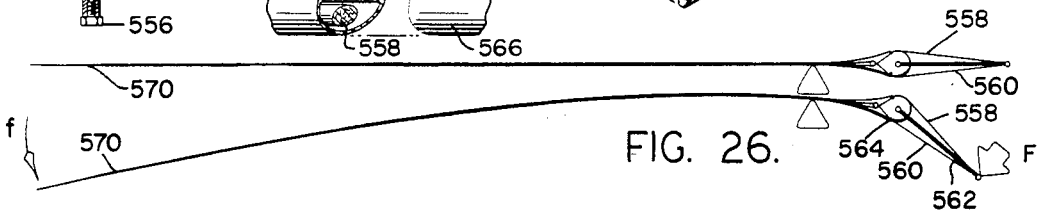
FIG. 26.
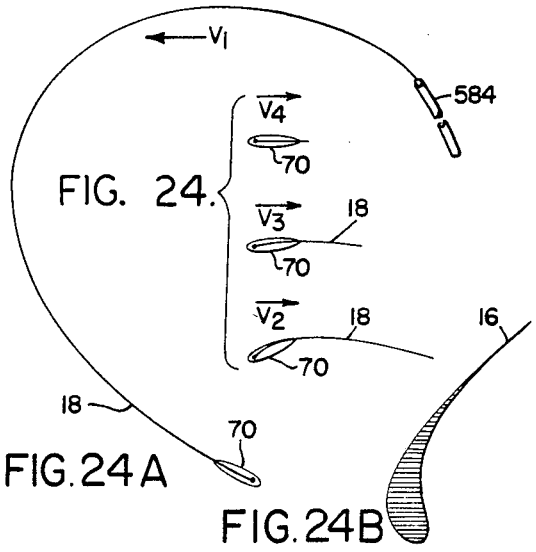
FIG. 24.
FIG. 24A
FIG. 24B
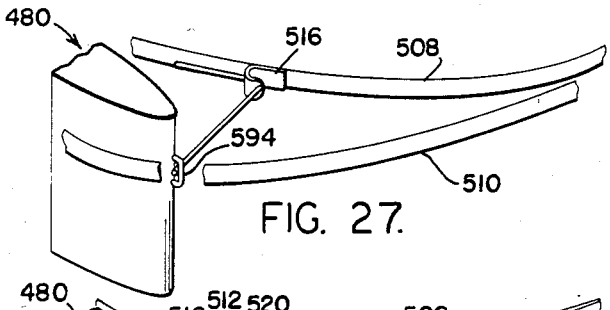
FIG. 27.
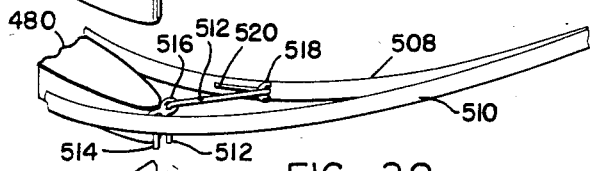
FIG. 28.
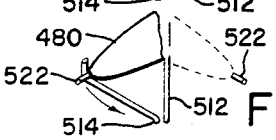
FIG. 28A 22b
22b
22a
667
29B
29C
29D
29E
29E
22
668
20
29B
664
12
29C
29D
672
674
96
632
10°

22
678
20
12
122
636
FIG. 29.A.

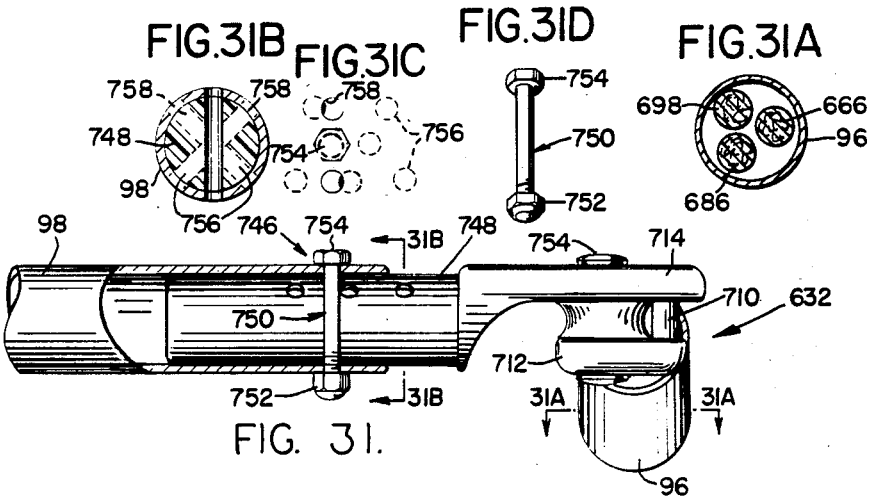
FIG. 31.
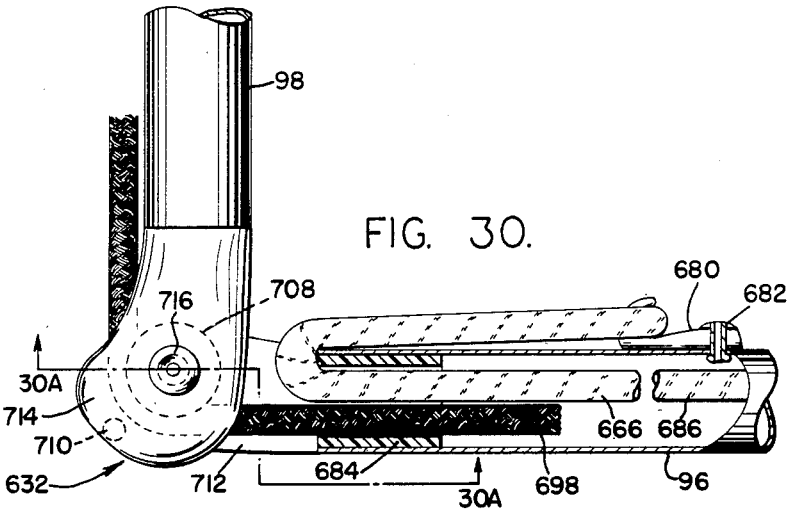
FIG. 30.
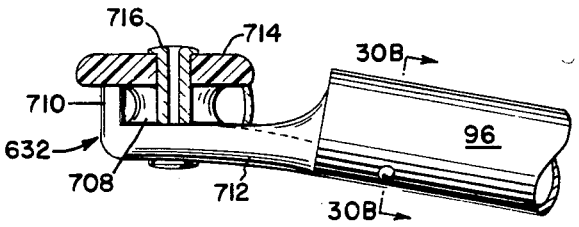
FIG. 30. A.
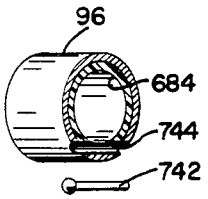
FIG. 30. B.

FIG. 37
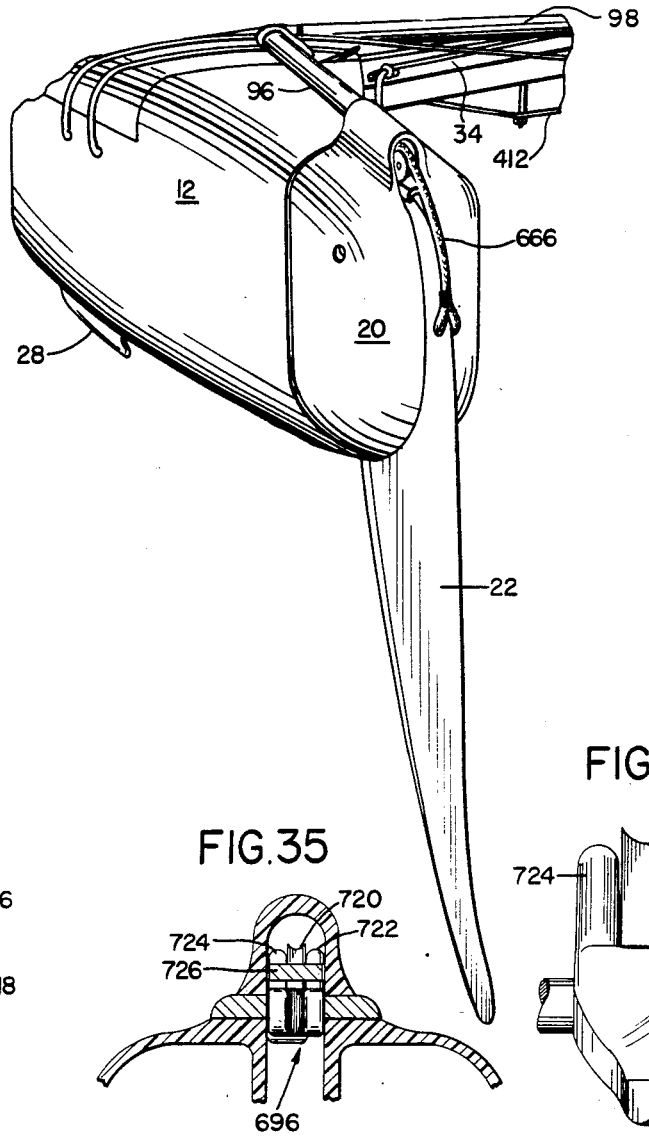
FIG. 35B
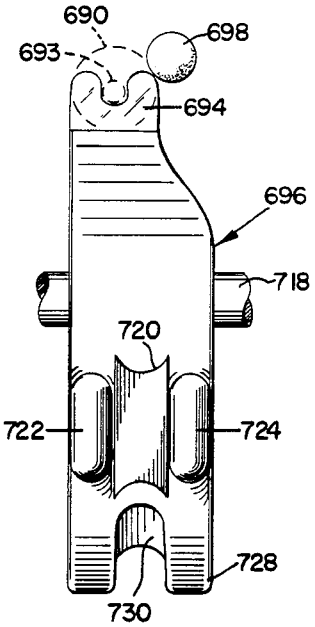
FIG. 35
FIG. 35A
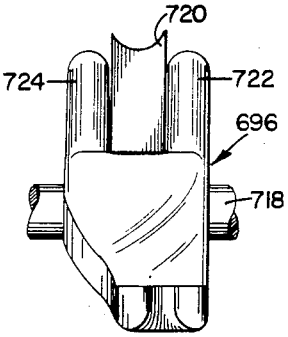
FIG. 34A
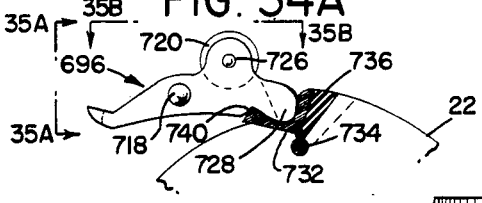
FIG. 34B
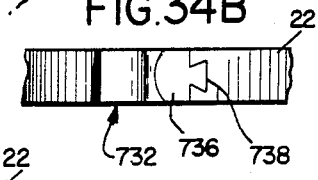
FIG. 34
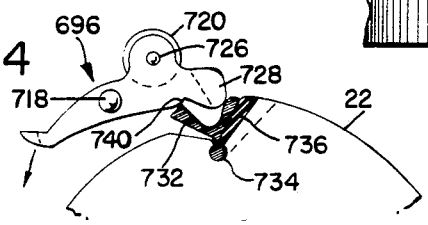

SAILING CRAFT

This is a continuation of application Ser. No. 278,095, filed June 28, 1981, now U.S. Pat. No. 4,463,699.

BACKGROUND OF THE INVENTION

The present invention relates to a sailing craft having improved hull, rudder, mast, main sail, trampoline deck construction together with other elements. The cooperation of the various components of the sailing craft interact in order to obtain improved operational performance.

Twin hull catamaran sailing crafts of the prior art are generally constructed of a frame work connecting the hulls and a conventional mast supported by the frame work. One or more rudders are provided. A deck is formed on the frame work for the support of the crew members. No high speed performance is provided for in such craft due to the conventional nature of the mast, main sail, and rudder combinations taken together with the shape of the hulls employed. Representative prior patents are: U.S. Pat. Nos. 2,712,293 to O'Higgins; 3,796,175 to Ford; 4,002,133 to Wilbanks.

In other sailing craft of a single hull design masts which are flexible in order to establish a bow within the longitudinal plane of the hull have been employed in order to flatten the sails for high aspect sailing into the wind. Masts of this type have not been associated with the air-foil type of masts in which battens have been employed in order to establish variations in the camber of the sail. U.S. Pat. Nos. 2,162,441 to Mead and 3,415,215 to Plym show such longitudinally bowed masts.

Another type of sail for single hull craft is represented by the air-foil type of sail in which internal battens are flexed in order to establish variable cambers such as shown by U.S. Pat. No. 4,064,821 to Roberts et al (FIGS. 11 and 12) and U.S. Pat. No. 2,561,253 to Wells-Coates which utilizes a leech cable along the trailing edge of the sail in order to flex internal battens. U.S. Pat No. 3,112,725 to Malrose is also of a similar type of sail in which the mast is permitted to rotate. These sails are characterized by their high weight due to the complicated internal components thereof and are not deemed to be acceptable for light weight catamaran sailing crafts.

Single hull vessels have also been fitted with one or more rudders which are designed for the normal pivoting motion as well as for a pivot motion in order to raise the rudders. Representative prior art is shown by U.S. Pat. Nos. 3,259,093 to Taylor; 3,788,257 to Miller.

Other approaches to providing air-foil type of masts require considerable additional structure and mast control lines as shown by U.S. Pat. Nos. 3,841,251 to Larson; and 4,047,493 to Menegus. Yet another approach utilized for a single hull smaller sized craft is shown in U.S. Pat. No. 4,074,647 to Delaney.

Other prior art not specifically mentioned above are U.S. Pat. Nos. 4,149,482 to Hoyt; and 1,613,890 to Hereshoff.

SUMMARY OF THE INVENTION

The sailing craft of the present invention is of a catamaran type having twin hulls of a novel configuration and having low turbulence rudder assemblies located at the stern ends thereof. A pitch-sensitive variable camber mast and main sail combination is rotatably mounted on a cross beam frame work which interconnects the two hulls. The concept, design, construction and mode of operation of the mast and main sail combination mounted upon a twin hull catamaran base provides sailing results which have not heretofore been obtainable. The steering of the craft by the two low-water-turbulence rudders and the unique hull configuration provides forward speeds of from 28 to 34 knots under a wide range of wind velocities. The mast is designed to pivot from a high aspect camber position to a low aspect camber adjustement as the wind velocity drops to thereby create compensating forward thrusts for the entire craft. In order to attain this result, the mast is allowed to bow into a concave configuration with respect to the incoming wind vector when the mast and main sail combination are in the high aspect configuration wherein the mast is bowed away from the longitudinal plane of the craft. When the wind velocity drops the concave bow in the mast straightens out and the mast establishes a lower pitch with respect to the longitudinal plane of the craft and a low aspect camber adjustment is formed in the main sail.

The main sail has flexible battens integrally formed therein in order to maintain camber adjustments.

The rudder assembly is of a novel form which allows the crew to raise the rudder from a sailing position to a trailing position. The rudder is also releasable upon contact with underwater objects and is lowerable into sailing position by the crew by utilization of a rudder control means during sailing.

The hull configuration substantially contributes to the high performance of the present craft. The materials of construction and overall design of the various components cooperate in unique manners including the cooperation of the port and starboard cable stays with the mast, and the cooperation of the cross beams with the twin hulls. A novel hull lid is integrally formed with the trampoline cloth in order to provide a catamaran craft with dual hull storage compartments.

It is therefore an object of the present invention to provide a twin hull catamaran sailing craft which is simple to maintain and operate and which will give high speed performance over a wide range of wind velocities.

Yet another object of the present invention is to provide a novel rudder assembly which can be used with various sailing crafts.

Yet another object of the present invention is to provide a novel hull configuration which can be employed on catamaran or single hull vessels.

Another object of the present invention is to provide a novel pitch-sensitive variable camber mast in which a lateral bowing of the mast in a transverse plane to the direction of motion of the sailing craft is provided for use with cataraman twin hull vessels and single hull vessels.

Yet another object of the present invention is to provide a novel deck and trampoline structure for catamaran sailing craft.

Another object of the present invention is to provide a novel mast and main sail configuration wherein the sail is provided with battens which form variable camber positions.

BRIEF DESCRIPTIONS OF THE DRAWINGS

FIG. 8 is a perspective view of the two twin hulls of the catamaran sailing craft showing the keels of the hulls;

FIG. 9 is a schematic side view of the keel shape of the hulls and illustrates the protective bottom strip used for wear-resistance;

FIG. 9A shows an enlarged cross-sectional view taken on line 9A—9A of FIG. 9 and a portion of the hull showing the protective bottom strip;

FIG. 9B shows an enlarged cross-section of the keel taken along line 9B—9B of FIG. 9;

FIG. 9C shows an enlarged cross-sectional view of fthe rear portion of the keel taken on line 9C—9C of FIG. 9;

FIG. 9D shows the bottom protective strip of FIG. 9B removed from the hull and illustrates the adhesive area which joins the protective strip to the keel;

FIG. 9E shows an alternative mechanical means for joining the bottom protective strip to the keel;

FIG. 10 shows a side elevation view of a shroud adjuster used to releasably connect various shroud lines on the catamaran;

FIG. 10A is a cross-sectional view taken on line 10A—10A of FIG. 10 showing the positioning of two shroud lines therein and showing the internal gripping teeth;

FIG. 10B is an end view of the shroud adjuster illustrated in FIG. 10 with the shroud lines removed;

FIG. 10C is a detail cross-section of one of the rivets used to join the two halves of the shroud adjuster;

FIG. 12 is a cross-sectional view of a modification of a shroud line anchor affixed in the hull wall;

FIG. 12A is a perspective view of the internal cleat wedges removed from FIG. 12;

FIG. 13 is another modification of a shroud line anchor means in which the shroud line passes through both inner and outer hull walls for additional strength;

FIG. 15 is a top plane view of the main U-beam and the rear U-beam together with the trampoline cloth shown extending under cushions arranged over the hull lids;

FIG. 15A is an enlarged perspective, cut-away view of the foot straps shown extending parallel to the length of the hulls across the trampoline sheet taken at the portion identified as 15A on FIG. 15;

FIG. 15B is an enlarged cross-sectional view of the central trampoline tube which connects the center portions of the two U-beams;

FIG. 15C is a schematic view of the main U-tube shown supported between the two catamaran hulls and showing the mast support rod centrally located therein;

FIG. 16 shows a schematic front elevation view of the low profile main sail anchor post, car tract and stick holder;

FIG. 17 is a perspective cut-away view of the front portion of the trampoline tube and tube casting showing the connecting portion for joining the two U-beams;

FIG. 17A shows the snap ring used to secure the trampoline tube in position within the trampoline tube casting shown in FIG. 17;

FIG. 18 shows a fragmentary cross-sectional view of the main U-beam resting in the beam pocket in one of the hulls;

FIG. 18A shows a detail of the dolphin striker rod anchor positioned under the main U-beam;

FIG. 18B shows the top cross-sectional view of the rod anchor extrusion shown in FIG. 18A taken on line 18B—18B;

FIG. 19 is a cross-sectional schematic view of the front U-beam shown secured in the beam pocket and showing the securing means for the trampoline cloth;

FIG. 19A is a view of a comfort line cable which is joined between the two U-beams on either side of the trampoline tube and which forms a core for one of the foot straps;

FIG. 23 shows a fragmentary detail view of the mast supported by the dolphin striker rod and the mast support rod;

FIG. 23A shows the mast of FIG. 23 in lowered position;

FIG. 23B shows a schematic cross-sectional diagram of FIG. 23A taken on line 23B—23B with the mast removed.

FIG. 24 shows a schematic cross-sectional view of the jib air-foil cover and the jib sheet at a low wind velocity $V_2$, an intermediate wind velocity $V_3$ and at a third, higher, wind velocity $V_1$ in which the jib is nearly rolled up in the cover;

FIG. 24A shows the fully extended jib air-foil in Genoa position shown by a diagramatic cross-section taken on line 24A—24A of FIG. 20 for utilizing a tail wind illustrated by the lowest wind velocity vector $V_1$;

FIG. 24B shows a horizontal schematic cross-section of the main sail in a tail wind position with respect to the jib air-foil of FIG. 24A;

FIG. 25 is an exploded view of two batten tracks and a clip core which provide for relative flexing of the mated battens on each of the main sail sheets as shown in FIG. 22A;

FIG. 26 shows a schematic view of a batten flexing control lever shown in an unflexed position and a flexed position as denoted by the force vector F;

FIG. 26A is an enlarged view of the hollow tube battens and pull cords therein for illustrating FIG. 26 in detail;

FIG. 27 is a detail schematic view of the batten flexing means shown in FIG. 22B for aiding establishment of different cambers for the main sail;

FIG. 28 is a detail schematic view of the batten flexing means shown in FIG. 22A for aiding establishment of different cambers for the main sail;

FIG. 28A shows the base portion of the mast where the lines are secured and are pulled to both the left and right by a pin in the mast which contacts each batten line to form and release camber adjustments;

FIG. 29A is a top schematic view of FIG. 29 with the rudder tube removed;

FIG. 30 is a partially cut-away view of the rudder tube and elbow hinge shown attaching the connecting tube and the rudder tube;

FIG. 30A is a side elevation view of the rudder tube elbow hinge shown in cross-section with the rudder tube shown in side view and taken on line 30A—30A of FIG. 30;

FIG. 30B is a cross-sectional perspective view of the rudder tube shown in FIG. 30A taken on line 30B—30B with the fastener pin removed;

FIG. 13 shows a partially cut-away front view of the rudder tube elbow hinge of FIG. 30 and the toe-in adjustment means;

FIG. 31A shows the cross-section of the rudder tube with the two length of the bungy cord and the single control cord located therein as taken on line 31A—31A of FIG. 31;

FIG. 31B is a cross-sectional view of the tiller connecting tube showing the toe-in adjustment holes with the connecting bolt removed;

FIG. 31C shows the top hole positions on the tiller connecting tube and the underlying hole patterns in the elbow hinge in a planar schematic diagram with the connecting bolt shown in the central hull position;

FIG. 31D shows a perspective view of the connecting tiller tube bolt;

FIG. 34 is a schematic side view of the rudder trip lever and the pivotally heel support shown in the releasing position;

FIG. 34A shows the trip level and top portion of the rudder with the trip level in fastened position;

FIG. 34B shows the top portion of the rudder with the pivotal heel support and the compressible rubber wedge illustrated schematically;

FIG. 35 shows a rear cross-sectional view of the rudder trip level mounted in the rudder housing;

FIG. 35A is an enlarged front elevation schematic view of the rudder trip level taken on line 35A—35A of FIG. 34A;

FIG. 35B is an enlarged top schematic view of the rudder trip level taken on line 35B—35B of FIG. 34A;

FIG. 37 is a rear view of one of the hulls showing the rudder housing and the extending rudder in sailing position and also showing the rudder tube and the tiller connecting tube;

DESCRIPTION OF THE PREFERRED EMBODIMENTS

Figure 1:
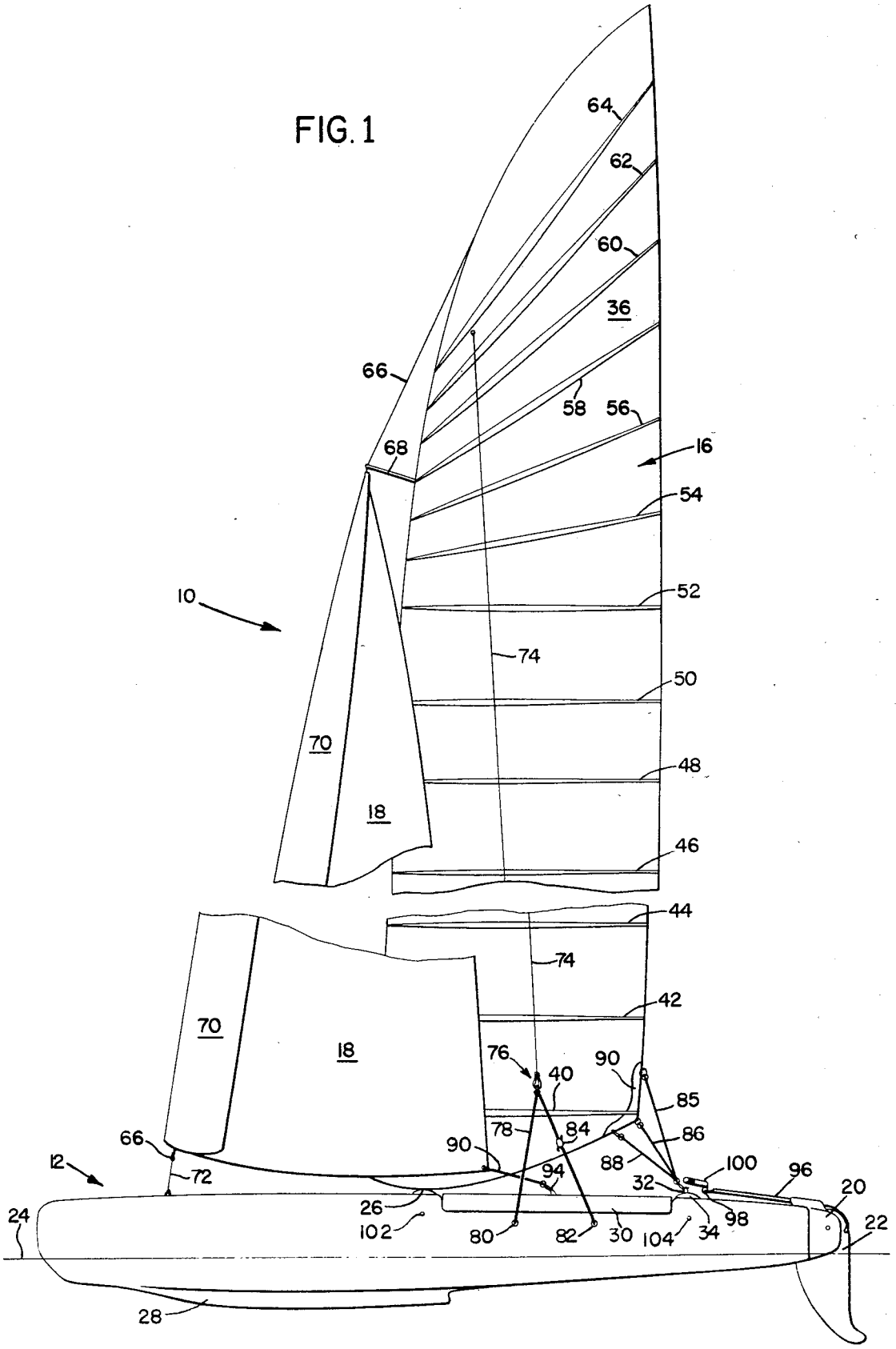
FIG. 1 is a side elevation schematic view of the catamaran sailing craft of the present invention.

Referring now to the FIGS. 1-39 and particularly to selected figures thereof, the catamaran sailing craft 10 of the present invention consists of a pair of hulls shown by the single hull 12 in side view and a paired hull 14 (illustrated in FIG. 8); a main sail 16; a jib air-foil 18 and a rudder housing 20 with a rudder 22 depending therefrom in sailing position. The water line 24 shows the overall buoyance of the craft 10 under sail in moderate wind. The main U-beam 26 joining the two catamaran hulls 12 and 14 can be seen under the main sail 16 at the point where it joins the tip surface of the catamaran hull. Hull 12 has an integrally molded dorsal keel 28 and a hull lid 30 which covers an internally formed storage compartment within hull 12. A main sail anchor post 32 is shown mounted on the rear U-beam 34.

Figure 22C:
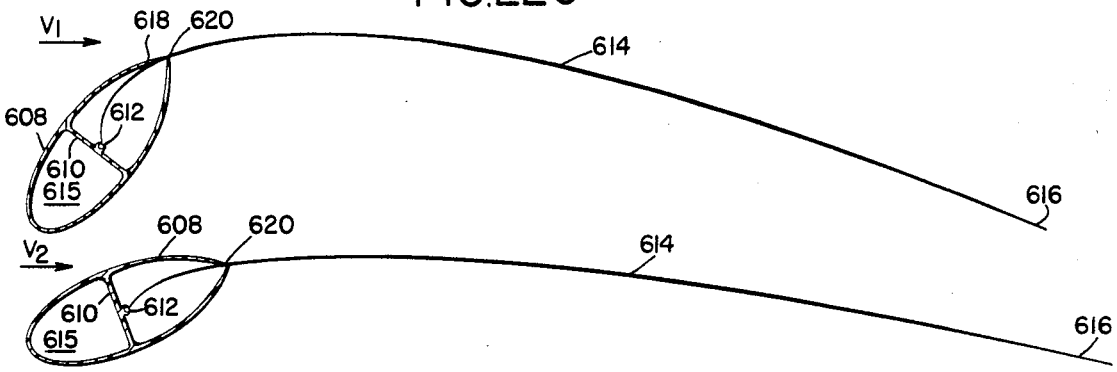
FIG. 22C shows another modification of a mast and main sail shown at a first wind velocity $V_1$ and at a second, higher wind velocity $V_2$.
Figure 22B:
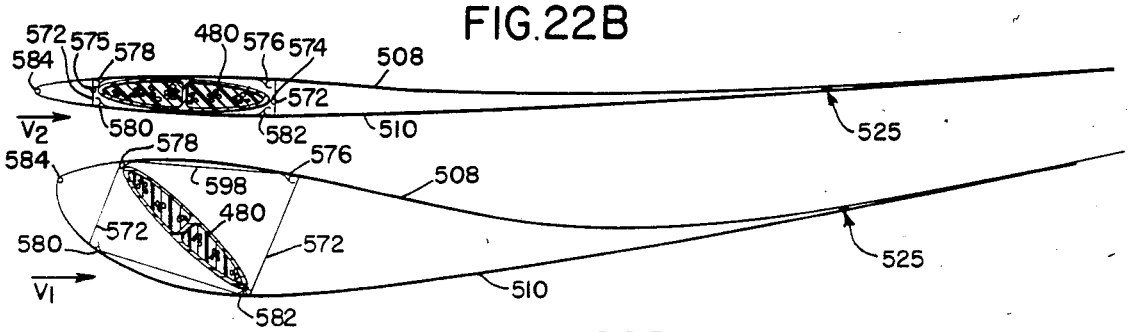
FIG. 22B shows another modification of the mast and main sail illustrated in FIG. 22A shown at the first wind velocity $V_1$ and a second, higher wind velocity $V_2$.
Figure 22D:
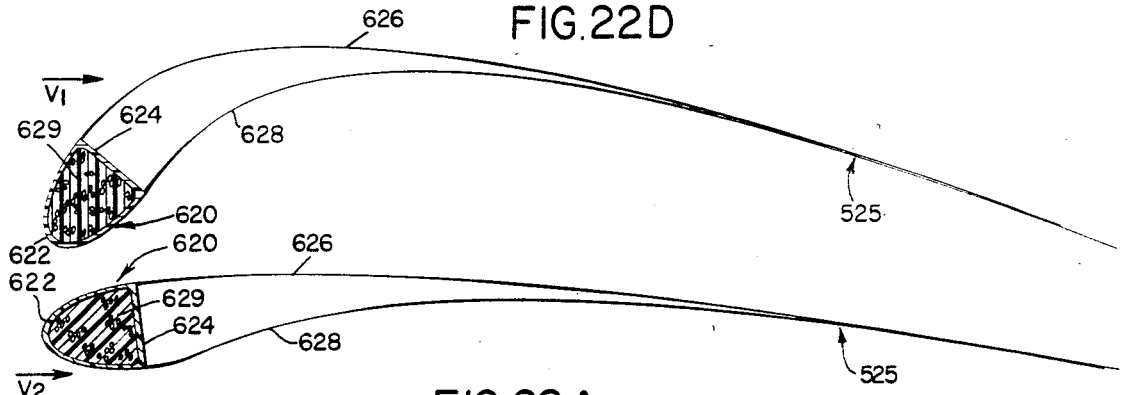
FIG. 22D shows a fourth modification of the mast and main sail shown in FIG. 22A at a first wind velocity $V_1$ and a second, higher wind velocity $V_2$.
Figure 22A:
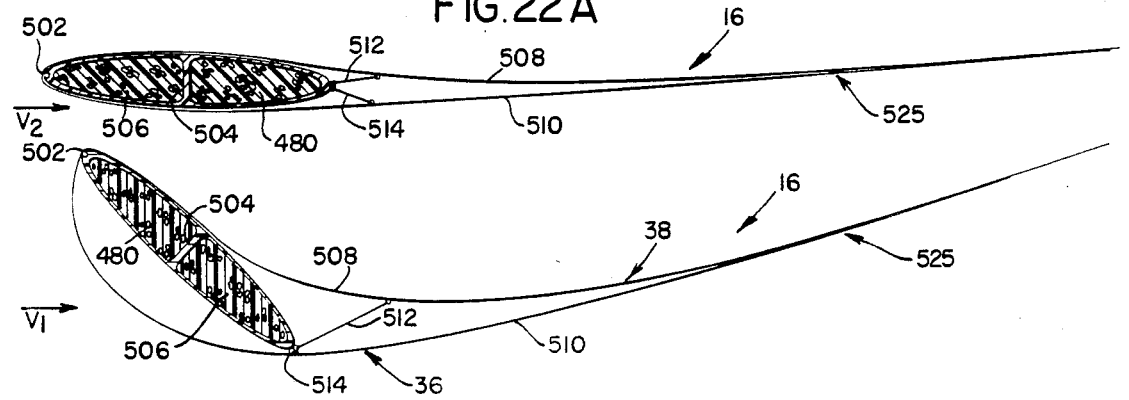
FIG. 22A shows a cross-sectional view of the mast and main sail of FIG. 20 taken on line 22A—22A at a first wind velocity $V_1$ and at a second, higher wind velocity $V_2$.

The main sail is composed of first and second main sail sheets 36 and 38 (shown in FIG. 22A). These two main sail sheets are joined at the leading edge of the mast as shown in FIG. 22A and thus extend on either side of the mast. A series of battens 40–64 are integrally molded with main sail sheet 36 and a mating set of battens are integrally molded with main sail sheet 38 also.

A front cable 66 is shown spaced from the leading edge of the main sail 16 by a jib spacer 68. The front cable extends downwardly through the jib foil cover 70 and is connected to a shroud adjuster line 72 which is, in turn, connected to the front portion of hulls 12 and 14.

A cable stay 74 is shown connected through the main sail sheet 36 to the upper portion of the mast (not shown). The lower end of cable stay 74 is integrally molded into a quick-release hook 76 which connects to a shroud line or rope 78 which is secured by both ends thereof through hull anchor openings 80 and 82. A shroud adjuster cleat 84 is shown positioned in one of the links of the shroud rope 78.

Sail shroud lines 85, 86 and 88 are shown connected to a reinforcement corner plate 90 on the trailing corner of the main sail 16 and are in turn shown connected to the sail anchor post 32. A jib shroud line 90 connects the trailing corner of the jib air-foil 18 to a foot strap 92 shown in FIG. 15. A shroud adjuster cleat 94 is utilized as a jib rachet for the connection.

Figure 15D:
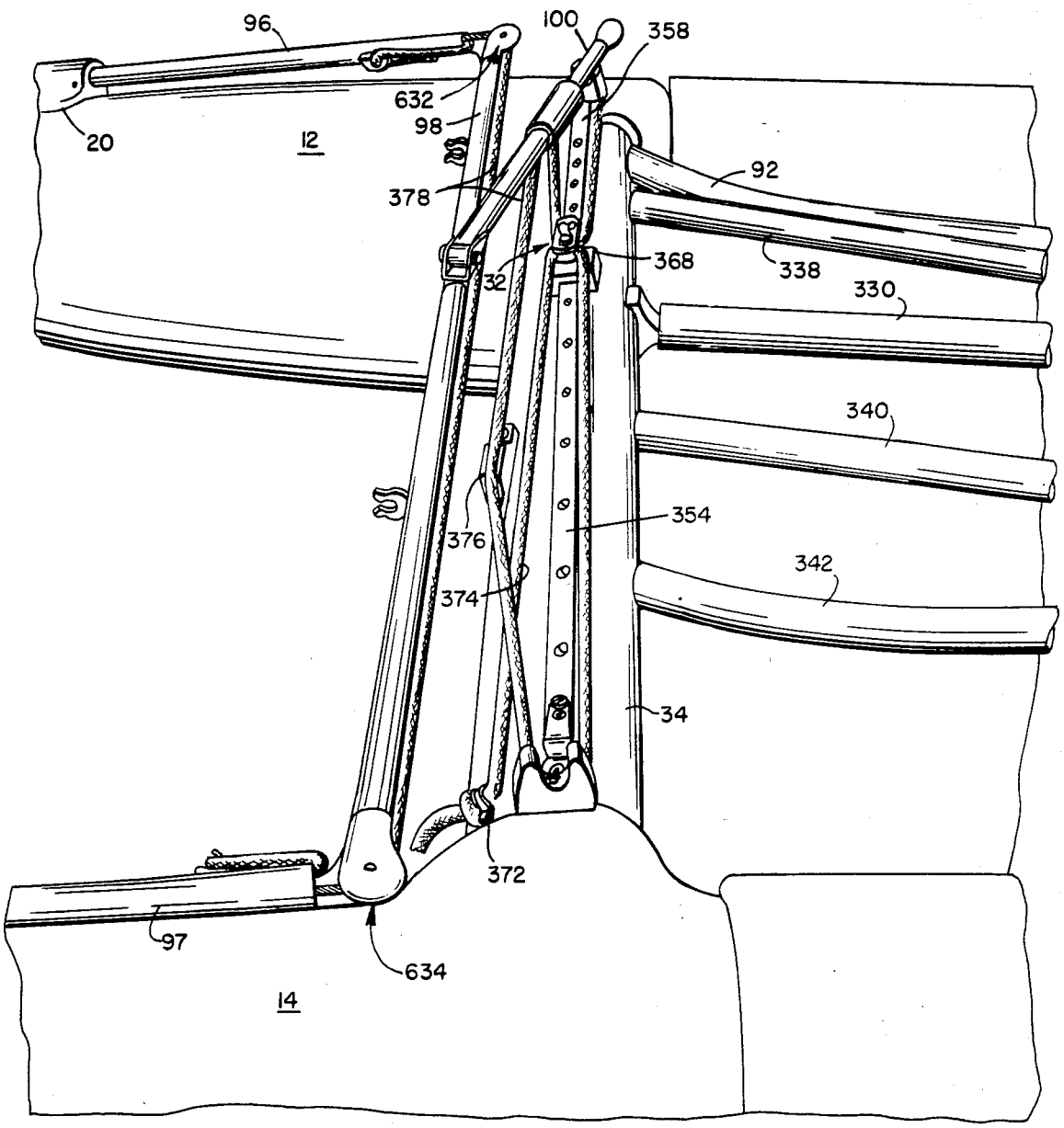
FIG. 15D is a perspective view of the rear U-beam shown connected between the two hulls with other elements shown in storage positions.

A rudder tube 96 is connected to the rudder housing 20 and a tiller tube 98 is connected between the two rudder tubes for the two rudder housings on each of the mated hulls. A cat stick or tiller 100 is pivotally connected to the tiller tube at a central position thereof as shown in FIG. 15D.

Hull drain holes for the beam pockets 102 and 104 are also shown in FIG. 1 positioned above the water line 24.

Referring now to FIGS. 2–7C, details of the two catamaran hulls 12 and 14 are shown. The integrally molded keel 28 has an S-curved stern portion or tail 106 which is located at a relatively forward position with respect to hull 12 in that the entire keel is positioned in the front one-half of the hull 12. The hull 12 is formed by relatively straight vertical side walls 108 and 110 (shown in FIG. 2A) and has a semi-circular bottom portion 112 which gives maximum buoyance to each of the hulls 12 and 14 even in various vertical positions in which one of the hulls rides above the water surface. The shallow keel draft and the short keel length provide for quick and highly reactive turning capability for the catamaran sailing craft 10 in all wind conditions. The dorsal keel 28 is formed on the bottom of the hull 12 close the lowest hull depth and at the front portion thereof is nearly as wide as the bottom portion of the hull and is an integral part of the hull and hence has a semi-circular configuration as shown in FIG. 9A. This unusual longitudinal keel configuration reduces water drag as compared to dagger boards improves steering response, and improves stability. The position of the dorsal keel 28 with respect to the rounded bow portion 114 operates so as to improve steerability and provide steering stability and speed. The S-curved keel tail 106 reduces water turbulence. A satisfactory keel cross-sectional area has been found to be 260 sq. inches for a 17 foot hull.

Figures 2, 2A, 3, 4, 5, 6, 7A, 7B, 7C:
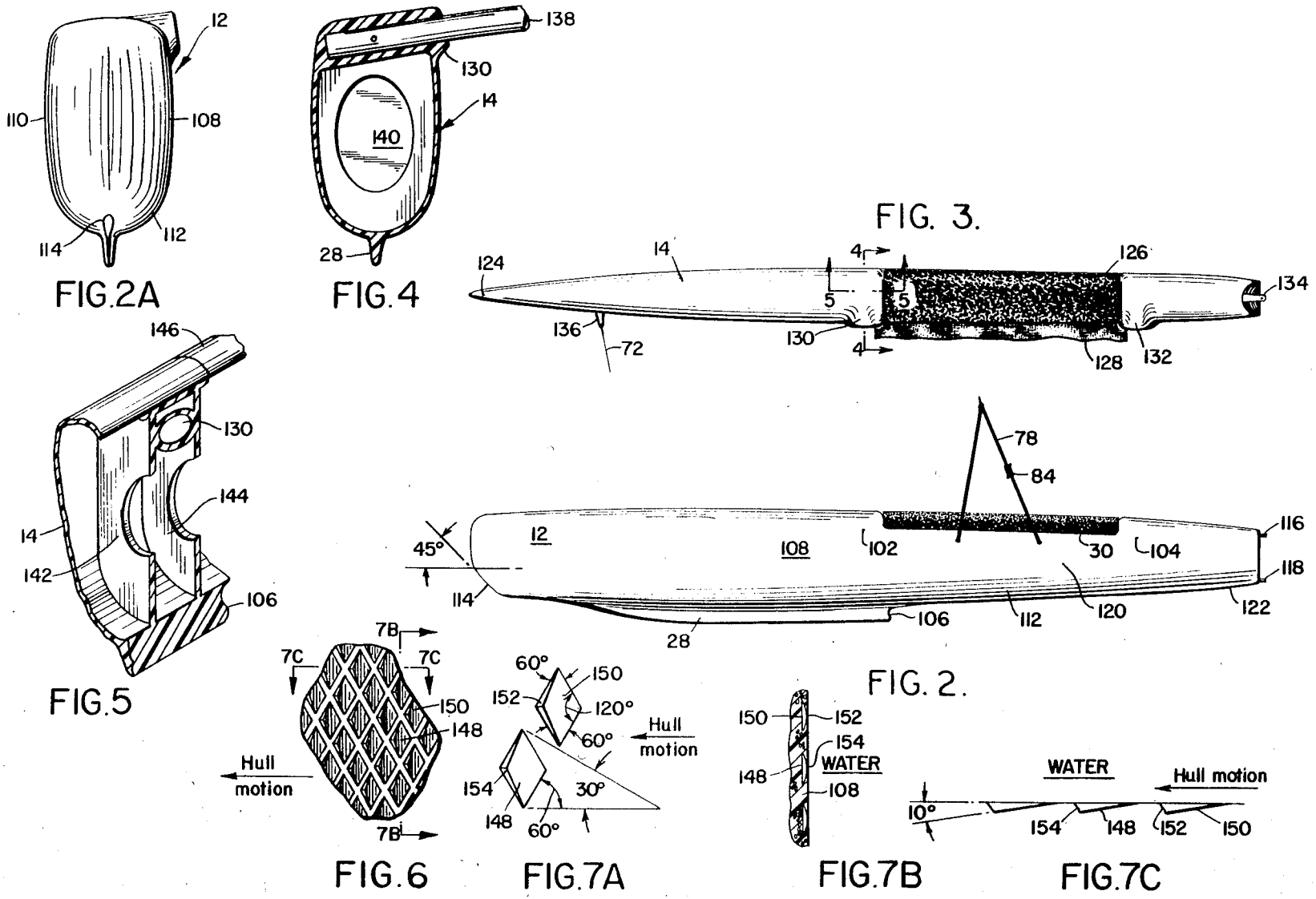
FIG. 2 is a side elevation schematic view of one of the catamaran hulls.
FIG. 2A is a front elevation schematic view of the hull of FIG. 2.
FIG. 3 is a top elevation view of the hull of FIG. 2.
FIG. 4 is a cross-sectional view of the hull of FIG. 3 taken on line 4—4 of FIG. 3 showing the main U-beam retained within the beam pocket in the hull.
FIG. 5 is a cross-sectional fragmentary view of the beam pocket which also shows the cross-section of the keel.
FIG. 6 is an enlarged view of a preferred form of the surface skin of the hull with the direction of motion of the hull shown by the associated arrow.
FIG. 7A is an additional enlargement of the diamond-shaped pattern of FIG. 6.
FIG. 7B is an end surface view of the slightly depressed diamond-shaped elements composing the skin pattern of FIG. 6.
FIG. 7C is a top view of the diamond-shaped elements with the direction of motion of the hull shown by an arrow.

Also shown on FIG. 2 are the upper and lower rudder hinges 116 and 118. The nearly vertical side wall can have a curvature of 3/16 inches on center per 1 vertical foot of wall height.

The last two-thirds of the hull length 120 has a straight taper to the end portion 122 which then has a smooth curvature taper into the rudder housing 20 shown in FIG. 1. This end portion 122 accounts for about 1/17 of the hull length.

The bow portion 114 is formed with a 45° angle to the water surface and has a rounded front portion as shown by FIG. 2A but a sharp angled bow upper part in the horizontal plane.

The opposite hull 14 shown in FIG. 3 illustrates the sharp angle of the nose portion 124 which corresponds to the bow portion 114 of hull 12. The hull lid 126 corresponds to hull lid 30 of FIG. 12 and the trampoline cloth 128 extends between the two hull lids 30 and 126 and is integrally molded therewith.

Also shown in FIG. 3 are the top views of the main U-beam pocket 130 and the rear U-beam 132 which are integrally molded with the hull 14. The upper rudder hinge 134 is also shown for hull 14. The front shroud line 72 is shown connected to a shroud anchor 136 which is integrally formed in the top side wall of the hull 14. A corresponding shroud anchor is formed on the inner top side of hull 12 and in order to connect the shroud line 72 with the front cable 66 immediately below the jib air-flow cover 70.

The main U-beam pocket 130 accepts and provides support for the main U-beam 138 as shown in FIG. 4.

The dorsal keel 28 and the hull rear wall 140 are also shown. The main beam pocket 130 is integrally molded within the hull 14 as seen in FIG. 5. The U-beam support walls 142 and 144 are also shown as is the tail portion 106 of the dorsal keel 28. The upper lid 146 of the hull storage compartment is also shown in this Figure.

FIG. 6 is an enlarged view of the diamond-shaped pattern of the preferred hull skin. FIG. 7A shows the spacing of the diamond-shaped pattern elements 148 and 150 in which a horizontal line connecting the bottom of element 148 is used as a reference and another line at 30° to the horizontal reference line is then established connecting the top of diamond-shaped 148 to the horizontal reference line. The illustrated diamond-shaped element 150 is then positioned on the 30° line at the midportion of the upper right hand edge of element 148. The 60° by 60° cornered diamond-shaped areas or elements 148 and 150 are all such elements as shown in FIG. 6 molded into the surfaces of the hulls 12 and 14 so that the leading corners thereof are at a position more closely spaced inwardly to the hull than are the rear corners as shown in FIG. 7B which is an enlarged front end view of a portion of the surface pattern wherein the element 150 is shown with an elevated rear corner 152 and element 148 is shown with an elevated rear corner 154. This relationship is also seen in the top view shown in FIG. 7C. In the various FIGS. 6–7C, the direction of movement of the hulls 12 and 14 are illustrated by the associated arrows. The effect of the diamond-shape pattern is to physically break the surface tension as the hulls move through the water to permit complete chemical wetting of the pattern elements by the water.

Referring now to FIG. 8, the twin hulls 12 and 14 are shown in perspective view without the main sail 16 or the jib air-foil 18. The rudder housing 20 and the rudder 22 are shown connected to hull 12 and a rudder housing 156 and a rudder 158 are shown connected to hull 14. The two ends of the shroud rope 78 are shown entering the side wall 108 of the hull 12 and the hull lid 30 is shown overlying the top portion of hull 12. The trampoline cloth 28 is also viewable between the two hulls. Rudder 158 is shown in the raised support position while rudder 22 is shown in sailing configuration. The joined hulls have an overall beam width of 8 feet for a 17 foot length.

Referring now to FIGS. 9–9E, the relationship of the dorsal keel 28 to the underside of the hull 12 is shown by a series of cross-sections taken at spaced positions along the keel length. The cross-section positions are shown in FIGS. 9A, 9B, and 9C. It can be seen that the dorsal keel 28 represents a continuation of the curvature of the hull sides 108 near the bow and as shown in FIG. 9A consists of a molded hard urethane keel protection strip 160 which is attached to the fiberglass composite hull bottom 162. An alternate construction is for a foam polymeric core for the strip 160 surrounded by one or more layers of a solid urethane coating. Whichever form of keel is used, the keel must be integrally bonded to the hull bottom. FIG. 9D shows a polymer bonding area 164 which provides for the necessary adhension. If desired, physical means such as connecting rods 166–176 can be secured through the hulls across the bottom of the hull as shown in FIG. 9E. The purpose of the urethane protective strip is to provide an undersurface of the catamaran hulls which will allow beaching the craft 10 on sand and gravel bars as well as to provide protection against collision with underwater objects such as rocks without damaging the hulls. If desired, suitable filled resin cores such as shown in FIGS. 9A, 9B, and 9C can be employed for the protection strip 160.

Referring now to FIGS. 10 through 10C, the details of the shroud adjuster cleat 84 are shown. The cleat 84 is formed of a lower and an upper half shell, 180 and 182 which are joined by a series of six metal rivets shown in detail in FIG. 10C. The sidewalls 184 and 186 have integrally molded internal teeth sets 188 and 190, respectively, which are joined to the side walls by their base portions and extend inwardly to their apices which are interstitially positioned as shown. The base portions of the internal teeth are elevated from the half shelf bottom walls illustrated as wall 192 in FIG. 10A whereas the apex portions are at the same levels as the bottom surfaces 192. In the opened form illustrated in FIG. 10A, rivet holes 194 and 196 can be seen in wall 184 whereas holes 198 and 200 are shown in wall 186. The molded corner posts 202 and 204 act as line guides for the two shroud lines 206 and 208 which pass therethrough. The terminal end 210 and 212 of the line can be saturated with a hardening silicon rubber or melted in order to prevent fraying. The form of the rivets 214 is shown in FIG. 10C. In operation, the gripping action of the top and bottom sets of teeth in the two cleat shell halves grip the shroud lines 206 and 208 as they are pulled by tensile force in the direction of arrows 216 and 218. In order to let out more shroud line or to take one of the shroud lines through the cleat, it is necessary to reduce this tensile force by manual manipulation of the shroud lines. The binding of the two shroud lines 206 and 208 one upon the other also acts to cleat the two ropes together. The cleat 84 can be manufactured from reinforced thermo setting or other structurally rigid material.

Figures 11, 11A, 11B:
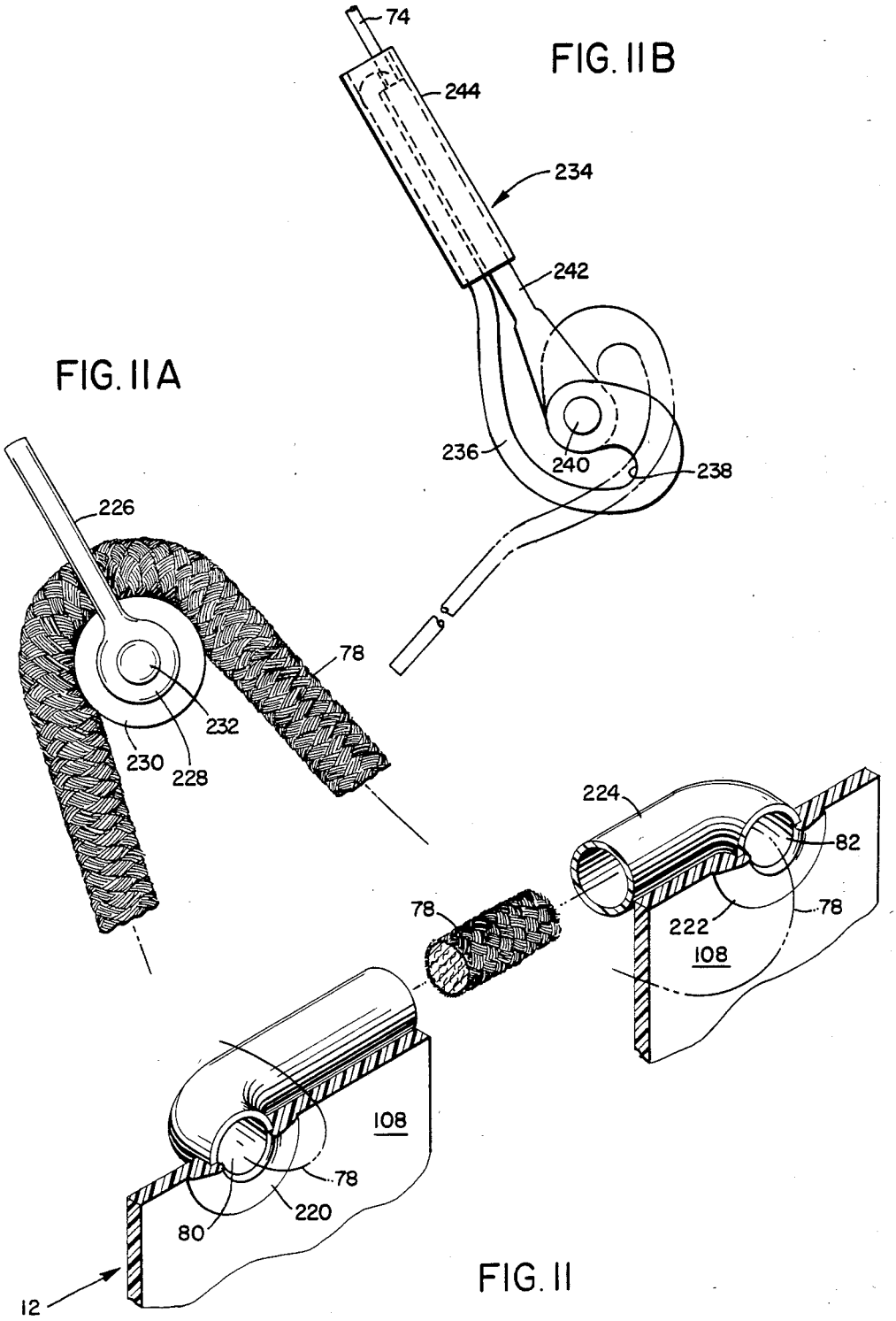
FIG. 11 is a cut-away perspective view of a shroud line anchor tube which is integrally molded into the hull side wall.
FIG. 11A is a side elevation view of the top portion of the shroud line of FIG. 11 shown supported at its upper end by a U-bolt and sheave.
FIG. 11B is a side elevation view of quick-release hook which joins the U-bolt of FIG. 11A to a cable stay which is in turn connected to an upper portion of the mast.

Referring now to FIGS. 11, 11A and 11B, the means of anchoring the shroud line 78 through the hull anchoring openings 80 and 82 are shown in an exploded presentation. The anchoring openings 80 and 82 are formed in side wall 108 as shown in FIG. 11 with integrally molded collars 220 and 222 and an anchoring tube 224 which passes to the interior of the hull wall between the two openings. The yacht braid 78 is then passed through one opening and out of the other opening and is then brought up the side of the hull and passed through a U-bolt 226 which has a plate 228 on one end thereof for retaining a pulley 230 by means of a rivet or screw 232. The shroud line 78 is then passed into one of the two line openings 206 or 208 of the shroud adjuster cleat 84 as shown in FIGS. 10–10B.

The other end of the shroud line 78 is then passed through the other of the two line openings in order to secure the shroud line 78 and to anchor the same through the side wall 108 of the hull. The cable stay 74 is connected to the shroud line 78 by means of a quick release hook 234 which is then hooked into the U-bolt opening 238 formed at the lower end thereof which is pivotally connected about a rivet pivot 240 to a stud 242 which is integrally molded onto the end of the cable stay 74. A reinforced urethane slidable handle 244 is provided to secure the end of the hook jaw 236 against opening. By sliding handle 244 upwardly along the cable stay 74, the hook jaw 236 can be opened into the position shown in phantom lines for connecting the cable stay 74 to the shroud line 78 provides a convenient mechanism for erecting the mast and sail on the main beam and also provides for necessary tension at the top of the mast in order to operate the same as will be hereinafter described.

FIG. 12 illustrated another embodiment of a hull wall anchor system for the shroud lines 72 and 78 wherein an anchor member 246 is integrally molded into an opening 248 formed through the outer hull wall. The anchor means 246 has a truncated inner configuration in which are positioned three segmental cleat wedges 250, 252 and 254 which have a series of teeth 256 molded onto the inner surfaces thereof. The cleat wedges are positioned between a hollow O-ring 258 located in the base portion of the anchor member 246 and a solid O-ring 260 located in the front portion of the concial interior. A shroud line 78 can then be passed in to the mouth 262 and out of the opening 264 which is located within the hull 12 when force is applied as shown by arrow 266 the cleat wedges 250–254 grip the shroud line as shown and prevent its exit from the anchor means 246. The shroud line 78 is then joined between two anchor means of the type shown in FIG. 12 and connected by a shroud adjuster cleat 84 as shown in FIGS. 1 and 10.

Another modification of the shroud line anchor is shown in FIG. 13 wherein a first tube 268 and a second 270 are integrally molded between the outer hull wall 108 and the inner wall 272 in order to provide for the passage of a shroud line 274 through tube 268 and then back through tube 270 in order to form a knot 276 on the outer side of the hull for securing of the shroud line 274 with respect to the hull 12. If desired, a rope-to-wire section 278 can be provided in order to connect the shroud line 274 to the cable stays 72 or 74.

Referring now to FIGS. 14, 14A, 14B and 14C, details of the hull lid 30 are set forth. The hull hatch lid 30 fits over opening 280 which is the most part of the storage compartment 143 which is located between the forward and rear beam pockets in each of the hulls. The hull lid is composed of a lower rigid lid base 282 and an upper lid cushion 284 which is fabricated from a polyurethane foam. The trampoline cloth 128 is integrally molded into the underside of lid cushion 284 and extends in this integrally molded configuration into the outer curvature of the lower lid and the lid cushion. The position of the outside edge of the trampoline cloth 128 with respect to the outer curvature is shown in the cut-away portion 286 in FIG. 14.

Figure 14:
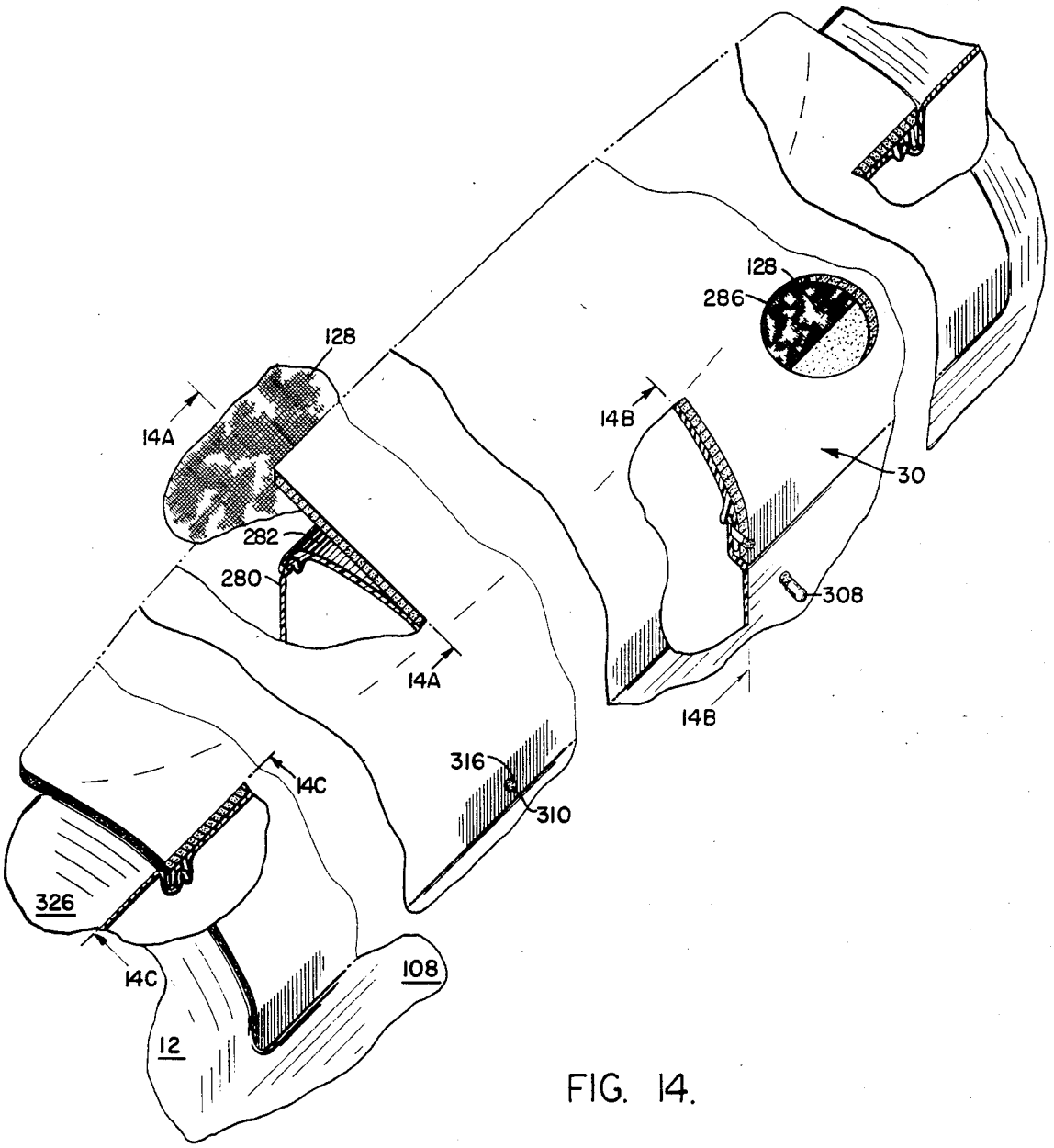
FIG. 14 is a fragmentary and cut-away achematic view of one of the hull lids which cover the storage compartment formed in the hull.
Figure 14A:
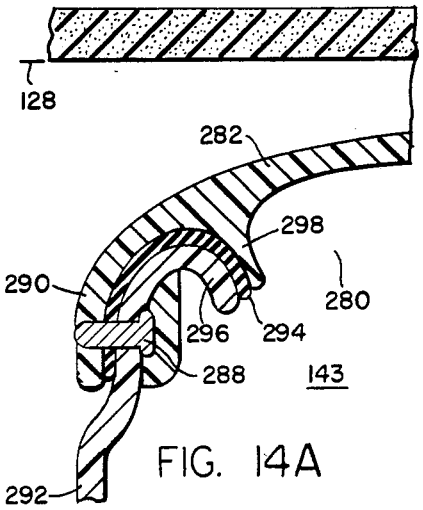
FIG. 14A is a cross-sectional view of the internal hinge of the hull lid showing the overlying trampoline cushion taken on line 14A—14A of FIG. 14.

The lower lid is designed to pivot about a hinge pin 288 which secures the inner most edge portion 290 to the interior hull wall 292 as shown in FIG. 14A. An elastomeric seal 294 is interposed between the arcuate shaped upper lip 296 of opening 280 and the mating hinge portions 298 of the lower lid 282. The outer edge portion 300 has an arcuate closure lip 302 which fits about the upper arcuate lip 304 of the outer hull wall 108 with a foam polyurethane lid seal 306 interposed therebetween. The hull lid 30 is secured in close position by two push buttons 308 and 310 which are positioned in a recessed housing 312 coaxially with an opening 314 and 316 formed in the lid cushion 282. The push buttons 308 and 310 are formed with downwardly curved cam surfaces 316 (as shown for push button 308) which cause the push button to retract due to compression of the resilient foam core 318 which is secured by a glue line 320.

Figure 14B:
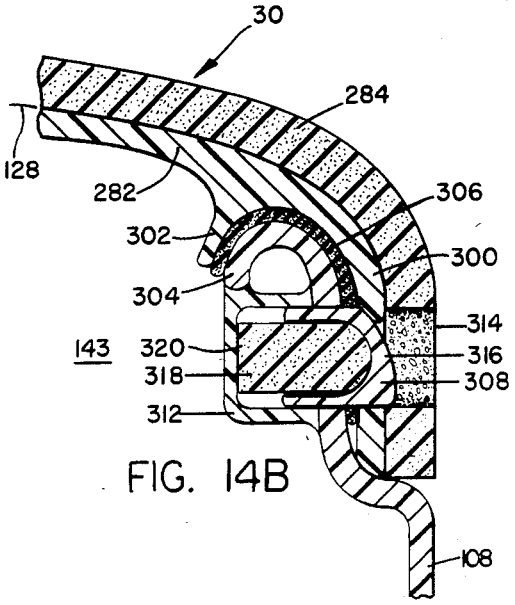
FIG. 14B is a cross-sectional view of the hull lid and the attached trampoline cushion taken on line 14B—14B at the outer side of the hull where a push button securing means is located.
Figure 14C:
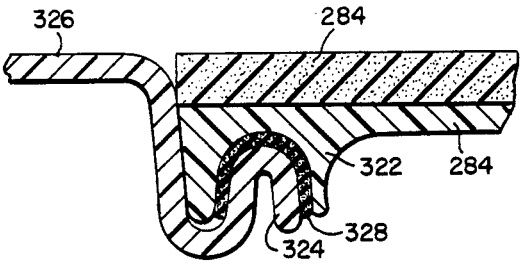
FIG. 14C is a cross-sectional view of the hull lid side seam taken on line 14C—14C of FIG. 14.

The lower lid 284 is also formed with U-shaped side portions 322 as shown in FIG. 14C which mate with arcuate side seam portions 324 which are formed from a portion of the hull top surface 326. A foam polyurethane seal 328 which is the lateral extension of seal 306 in FIG. 14B is also provided between the hull lip 324 and the lower lid 284.

In operation, a closed hull lid 30 is opened by depressing the push buttons 308 and 310 inwardly sufficient so that the outer portion 300 of the lower hull 282 can be moved upwardly and can then pivot about the hinge pin 288 in order to open the same. The trampoline cloth 128 and the lid cushion 284 also act as hinge means during this opening motion. The lower lid 182 can be formed from fiberglass composite and may have a foamed core therein (not shown). The lid cushion can be formed of ½" thick polyurethane foam.

CROSS BEAMS AND TRAMPOLINE ARRANGEMENT

Construction details for the cross beams and 26 and 34 and the trampoline cloth 128 are shown in FIGS. 15–15D and FIGS. 16–18B. The top plane view of the cross beams 26 and 34 having the trampoline cloth 128 stretched therebetween show the spacing of the two cross beams by the centrally located trampoline tube 330. This trampoline tube is secured to the rear cross beam 34 by a screw held housing 332. A trampoline tube retainer housing 334 is similarly affixed to the front or main cross beam 26 and is designed to slid into the front portion 136 of the trampoline spacer tube.

A series of foot straps 92, 338, 340 and 342 are provided across the top surfaces of the trampoline cloth 128 in order to provide the crew members of craft 10 with foot hold positions. The outer foot straps 92 and 342 have jib blocks 94 and 344 connected therein for securing the jib air-foil shroud line 90 as shown in FIG. 1. The jib air-foil 18 can be positioned on either side of the mast and when positioned on the port side as shown in FIG. 1, the jib shroud line 90 is connected to shroud jib block 94 and when positioned on the starboard side is connected to block 344. The hull lids 30 and 346 are shown with the overlying lid cushions 284 and 348 are shown as extensions of the trampoline cloth 128.

A mast support rod 350 is centrally located in the main cross beam 26. The rear cross beam 34 has a main sail anchor post 32 slidably mounted on a tract 354 which is secured to the upper surface of the rear cross beam 34. Track blocks 356 and 358 are positioned at either end of the tract 354 as shown in FIGS. 15 and 16. If desired, a cat stick holder or tiller 360 can be positioned at the outer edge of the track blocks 356 and 358 as shown in FIG. 16. The main sail anchor post 32 is shown schematically in FIG. 16 to consist of a follower car 362 which is moveably in line block 354, and 360. A pair of line guides 364 and 366 are mounted on the top surfaces of car 362 and in turn have the anchor post connections 368 mounted on a base member 370 which is connected to the top surface of the track 354.

In operation, a single car control line is threaded through the track sheaves 356 and 358 and through the car-mounted sheaves 364 and 366 in order to provide a slidable tract car movement along tract 354 as shown in FIG. 15D. The threading of the control line can be illustrated with respect to FIG. 15D where a first knot is tied in the line and secured by U-bracket 372 on the top surface of the rear cross beam 34. The control line 374 is then strung upwardly and through the car 366 located under the main sail anchor post elements 368. The cord is then drawn back to the starboard side in front of the tract 354 and is passed through the track sheave 358. After passing through the track sheave 358, the control line 374 is strung to the stern side of the rear cross beam 34 and is secured by the one-way clam clamp 376. Another cleat 378 is positioned on the port side of the center line and the car control line 374 is then threaded through the line quide 356 and hence back through the track sheave 364 shown in FIG. 16 and is then passed backwardly and knot formed therein and secured against the top surface of the cross beam 34 by another U-bracket similar to bracket 372. This arrangement of securing the tract car 364 by a control line arrangement allows for adjustment movement of the tract car along the tract 354 when the control line 374 is released from the cleats 376 and 378, but otherwise holds tract car 362 at a fixed position in order to secure the main sail lines 84, 86 and 88 in a centralized but variable position. FIG. 15D also shows the connections of the foot straps 92, 338, 340 and 342 to the rear cross beam 34. These connections secured by comfort line cables 458 are described with reference to FIG. 19A.

FIG. 15A shows the detailed construction of the foot straps which consists of a centrally located cable or cord 388 which can have a plastic sleeve 390 formed thereon. The sleeve 390 is adhered to a polymeric foam tube 392 which has a colorable vinyl coating 394 thereon. The centrally located cord or cable 388 with the plastic sheet 390 thereon can be secured to a connection line which is then passed through the beam and held by a cable end adjustment screw 458 (FIG. 19A) and is connected to jib blocks 94 and 344 which are similar to cleat 84 shown in FIGS. 10–10C.

FIG. 15B shows the cross section of the trampoline tie tube 330 which has a trampoline holding casement 396 formed in the undersurface thereof with an opening 398 through which the trampoline cloth 128 can pass. A trampoline positioning rope 400 is positioned within the casement 396 and the trampoline material 128 is passed in through opening 398 around the periphery of the securing rope 400 and then back through the same opening 398. This arrangement substantially prevents the shifting of the trampoline cloth 128 from starboard to port side during use of the craft 10. Similar securing rope casements are formed on the undersides of the two cross beams 26 and 34 in order to secure the bow and stern ends of the trampoline cloth 128 as shown in FIG. 19 and further explained below.

A quick-disconnect feature is provided for the connection between the trampoline tube retainer housing 334 and the trampoline tie tube 330 as shown in FIG. 17. A non-breakable plastic snap ring 402 is positioned in a notch 404 formed in the support stud 406 which is in turn secured to an arcuate shaped plate 406 which is curved to match the exterior curvature of the front cross beam 26. The snap ring 402 prevents the trampoline tie tube 330 from contacting the curved plate 406 and maintains tension on the trampoline cloth which is secured to the undersurfaces of both of the cross beams as shown by FIG. 19 for the rear cross beam 34. As shown in FIG. 17, the snap ring 402 extends below the internal casement 396 which contains the securing rope 400. In order to disassemble the cross beams 26 and 34 from the hulls 12 and 14, the snap ring is popped out by the use of a screwdriver wedged in the opening 408 thereof and the trampoline tie tube 330 is collapsed against the base portion of the trampoline tube retainer housing 334 so as to relax tension on the trampoline cloth 128. The cross beams can then be removed from the beam pockets if desired for transport of the sailing craft 10 in a collapsed form. It is possible to further dismantle the cross beams and trampoline as shown in FIG. 15 but this is not normally needed in operation or use of the craft. If desired, however, the securing cord 400 can be pulled out from the casement 396 via the opening 410 and the trampoline cloth 128 can then be entirely removed from both the front and rear cross beams by a manner hereinafter described with respect to FIG. 19.

FIG. 15C shows the mast support rod 350 being supported at its lower end by the dolphin striker rod 412. Also shown are the schematic connections of the main cross beam 26 with respect to hulls 12 and 14 also shown in FIG. 15D are the two rudder tubes 96 and 97 interconnected by the tiller tube 98 which has the cat stick 100 secured thereto in a central position as shown. The operation of the rudder tubes and tiller tubes will be described below with reference to FIGS. 29–32.

CROSS BEAMS-HULL CONNECTIONS

The main or fore cross beam 26 fits into a beam pocket 132 as shown in FIG. 18. This arrangement is duplicated for both of the hulls 12 and 14, and is illustrated with respect to hull 14 wherein the dolphin striker rod 412 passes through an opening 414 on the undersurface of the beam 26 and up to a notch 416 cut into the top surface of the cross beam 26. A striker rod anchor 418 is provided in order to anchor the securing nut 418 and an associated washer 420 thereon for tightening the dolphin striker rod 412. FIG. 18A shows a plan view of the interior anchor support walls 422 and 424 which are integrally molded during the manufacture of the main cross beam 26. A cross section of the dolphin striker rod anchor 418 is shown in FIG. 18B wherein a hole 426 is provided for passage of the dolphin striker rod 412 and wherein slots 428 and 430 are provided for locking about either side of the internal support walls 422 and 424. A hole 432 is provided through the end portions 138 of the main cross beam 26 in order to secure the cross beam within the beam pocket 130. The dolphin striker rod anchor 418 can be formed of a stainless steel or aluminum extrusion process.

FIG. 19 shows the interconnection of the rear or aft beam 34 with the beam pocket 132. A securing bolt 432 is shown passing through the front portion of the beam pocket 434 and the through the rear beam 34 and into a cast-in nut 436 which is integrally molded with the rear portion of the beam pocket during fabrication of the beam pocket within the hull 14, the position of which is shown in FIG. 3. A rubber washer 438 is provided immediately under bolt head 440 in order to prevent water leakage from the beam pocket. The bolt is positioned in the center of the pocket where there is least movement between the rear beam and the beam pocket 132. The bolt head 440 is accessible for tightening or loosening and complete removal by opening the hull lid 346 as shown in FIG. 15. The rear beam tube 34 can be preferably fabricated of pulltruded fiberglass or extruded aluminum. The preferred cross-sectional shape is an ellipse as shown in FIG. 19 with two internal support walls 442 and 444 with a rope guide casement 446 formed in the undersurface of the beam in a central position as shown. The cord guide casement 446 is in the form of a tubular opening 448 which extends along the underside of the beam tube 34. A cord is then passed through the end portion of the trampoline cloth 128 during fabrication thereof and sealed by an ultrasonic seal 450. This cord and the surrounding trampoline cloth loop 452 is then slid into one end of the opening 448 and along the entire length of the beam 34 which extends between the two hulls 12 and 14. If desired, the cord or line 54 can be formed with a rope or wire core 456.

FIG. 19A shows a detail of one of the comfort line cable ends 458 which are utilized as cores for the foot straps 92, 338, 340, and 342 and which cables join cross beams 26 and 34.

The main bolt body 460 has a slotted head 462 and a washer 464 on one end thereof and a threaded section 466 on the opposite end thereof. A internally threaded tube 468 is then screwed onto the threaded portion 466 after the bolt body 460 is passed through a hole drilled in one of the cross beams. A terminal connector 470 is then threaded into the opposite end of the tube 468 and is provided with a integrally molded hex nut 472 for adjustment of the length of the entire comfort line cable 458. A cable portion 388 as shown in FIG. 15A is then integrally molded into the terminal 470 and has a bolt head 476 on the opposite end thereof for passing through an opening drilled through the opposite cross beam. When connected by the internally threaded tube 468, the comfort line cables 458 can provide compressive force against the trampoline tie tube 330 in order to support activity on board.

MAST AND MAIN SAIL SHEETS

Figure 20:
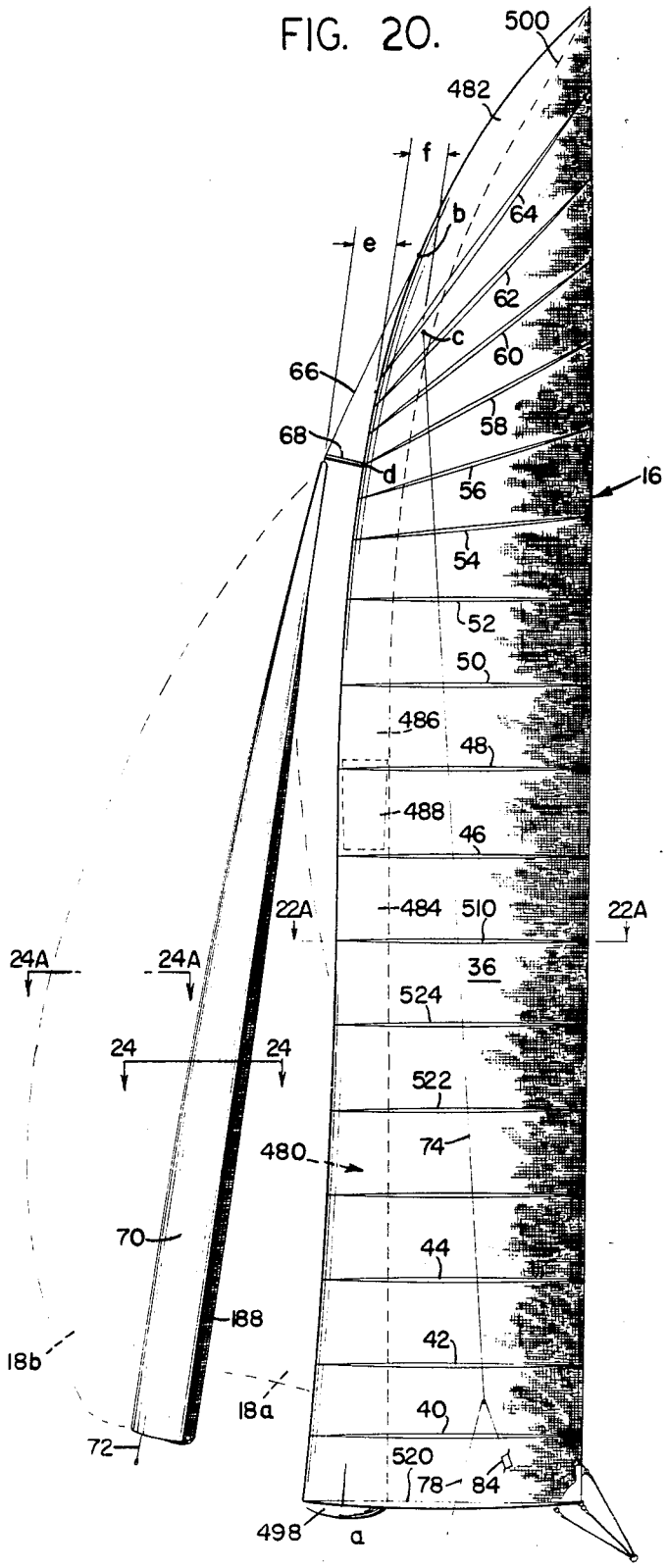
FIG. 20 is a side elevation view of the mast, main sail, and the jib air-foil cover.
Figure 21:
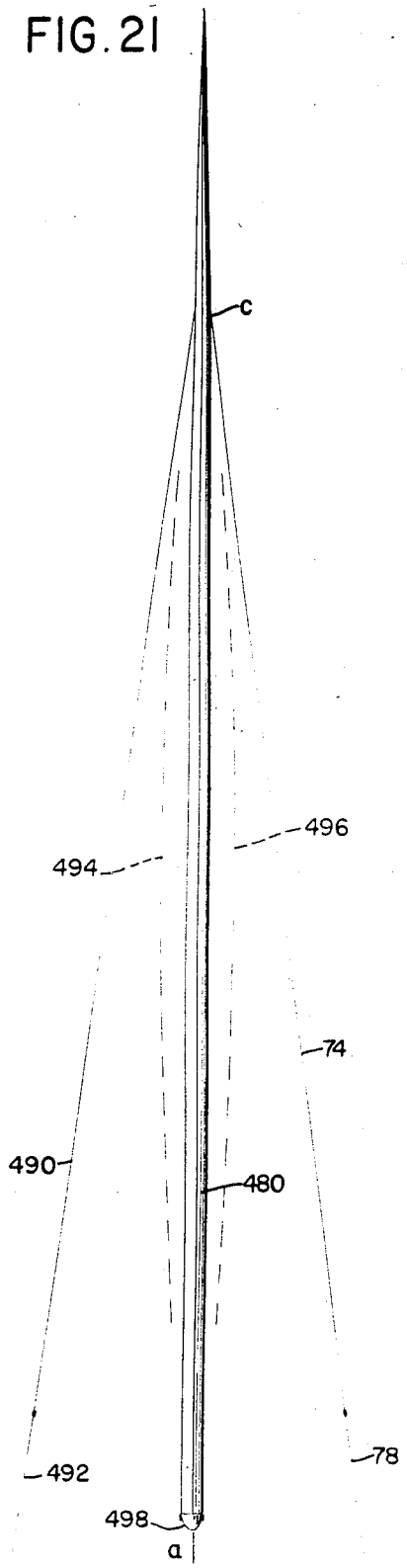
FIG. 21 is a front elevation view of the mast of FIG. 20 with the main sail and jib air-foil cover removed.

Referring now to FIGS. 20–28, the construction and operation of the main sail 16 and the mast 480 are set forth with various modifications therefore. FIGS. 20 and 21 show the mast 480 and the main sail 16 in side elevation view with the port cable stay 74 connected between the shroud line 78 and point c located in the upper arcuate section 482 of the mast. The mast 480 consists of a lower section 484 and an upper section 486 which are joined by a wedge-shaped stud 488 near the central position thereof. The jib foil cover 70 is shown in position in front of the main sail 16 with the jib airfoil 18 in furled form inside of the cover. The jib airfoil is shown in the normal jib position by 18*a* and in the Genoa position 18*b* in phantom lines. FIG. 21 shows the mast 480 and the port cable stay 74 and the starboard cable stay 490 connected to the shroud lines 78 and 492, respectively. In this view, the main sail sheets 36 and 38 have been removed in order to show the bowing of the mast 480 in a starboard direction 494 and a port direction 496 according to the dashed lines. The bowing of the mast occurs as the wind exerts force against the main sail during sailing. The extent of bowing which occurs is dependent upon the height of the connection point c above the base of the mast 498. The higher the connection point c is taken along the curved portion as shown in FIG. 20, the greater the bowing which will occur. When a high wind causes mast 480 to bow to the shape shown by dashed line 494 the tension is largely removed from stay 490. When the wind velocity decreases the mast 480 will pivot about the point c since it is hinged between that point c and the mast base point a shown in FIG. 20 the pivoting about point a will produce camber in the main sail 16. At the same time the bow will come out and the mast 480 will straighten.

The curved portion 482 at the top of the mast 480 provides a lever arm for aiding camber changes and minimum wind resistance under high speed wind conditions. A sail pocket 500 is provided in order to secure the top portion of the main sail sheets 36 and 38 over the top portion of mast 480. As shown in the preferred embodiment of FIG. 22A, the main sail sheets 36 and 38 are joined at the forward edge of mast 480 along sail guide line 502, but alternately the main sail sheets can be laid out from a single piece of sail cloth and joined along this guide. The mast 480 is shown to have an air-foil shape with an internal I-beam 504 constructed along the longitudinal length thereof. An internal filled core 506 is provided within mast 480 which can be formed of a foamed polymer material to provide for buoyancy and high tensile strength. The starboard and the port side battens 508 and 510 are shown in diagramic sectional view in FIG. 22A. Under the force of a relatively low wind velocity, $V_1$, in which the main sail 16 is curved into a low aspect shape an arcute camber is formed. The flexing of the battens 508 and 510 is, in part, controlled by connecting batten lines 512 and 514 which are both guided by a line guide 516 in the manner shown in FIG. 28. Batten control lines 512 and 514 are secured to a fixed position on the trampoline tie tube 330 or another part of the trampoline deck. The lines can be arranged with batten line ties 518 in order to position the line of force more to the stern side of the mast and the lines can have their end positions 520 secured to the inside surface of the batten such as shown for batten 508 in FIG. 28. Upon the rotation of the mast the cords will cause a variable camber to develop. FIG. 28A shows in practice, the movement of the battens 508 and 510 by the pull rod 522 arranged to pull line 514 in the opposite direction in order to form the needed camber. The dotted line of the stern edge indicates the opposite angle of pull for rod 522.

In order to provide for holding the two main sail sheets 36 and 38 together along the stern edge thereof, each of the batten pairs can be provided with a batten clip arrangement 525 shown in exploded view in FIG. 25. In the form shown, the battens 508 and 510 are formed with a clip portion 526 and 528 which have keyed slots 530 and 532 formed longitudinally therein. An H-shaped clip 534 is then inserted, during construction of the main sail, into the two key slots 530 and 532 in order to slidably join the battens 508 and 510 along the position shown in FIG. 22A. The sheets 36 and 38 are designed to be slid out from the lower and upper mast sections 484 and 486 for dismantling.

OPERATION OF THE MAIN SAIL

The main sail 16 and mast 480 functions as a pitch-sensitive variable camber mast and main sail combination. The camber in this arrangement is controlled by the dimensions e and f illustrated at the top of FIG. 20 and by the positioning of the connection points a, b, c, and d. The location of these connection points and specifically the distances e and f control the variable camber adjustment. The mast rotation is automatic at various wind velocities about a line connecting points a and c, the hinge points. The jib cable 66 is molded into the curved portion 482 at the top of the mast 480 and establishes connection point b. Connection point a is the connection of the mast base 498 with the mast support rod 350 shown in FIG. 15C. The connection point c can be varied upwardly from the position illustrated in FIG. 20 to about halfway toward the mast tip end in order to achieve variable bowing as shown in FIG. 21. Connection point d is the connection of the front edge of the mast with the jib spacer bar 68 which is also connected inside mast 480 to I-beam 504.

The mast then rotates along a vertical axis having connection point a at its lower end and passing through connection point c at its upper end. As the mast rotates the camber positions illustrated in FIG. 22A are formed.

The bowing of the mast as shown in FIG. 21 and the rotation of the mast and curving of the paired battens to form various cambers as shown in FIG. 22A vary in an inter-related fashion in order to cause the mast rotation and therefore the camber adjustment to vary automatically with wind velocity and also to cause the mast bowing effect shown in FIG. 21 to operate automatically. Under a high wind velocity $V_2$ as shown in FIG. 22A, the mast will be bowed in either the starboard or the port directions as shown by the dashed-bow lines 494 and 496 in FIG. 21. This bowing of the mast under a high wind is facilitated by utilizing a pultruded fiberglass construction for the mast 480. The bowed position of the mast has conventionally been avoided in this art by the use of mast cables and spacers in order to strengthen the mast against bowing. In such conventional sails the trailing edge of the main sail is allowed to establish a bow in its trailing edge which much exceeds the bow of the mast. This condition increases as velocity increases. In the main sail 16 of FIGS. 20–22D, the trailing edge of the mast is maintained in substantially the same vertical curvature as the mast 480 over all wind velocities. The essence of the bowing position of the mast 480 under a high wind velocity, $V_2$ as shown in FIG. 22A, and the corresponding trailing edge curve of the sail 16 is that the normal straight and curved portions of the main sail 16 have been substantially altered from these conventionally taught in the sailing art and also in the catamaran sailing art. As the wind velocity decreases by dropping to velocity $V_1$ the bowing of the mast returns closer to a straight vertical position as shown in FIG. 21 thus relaxing the tension of the cable stay in the direction of the wind. The relaxation of this tension then permits the rotation of the mast 480 about the connection points a and c in order to form the low aspect camber shown in FIG. 22A with velocity $V_1$. The relative tensions in the cable stays 74 and 490 thus change to more equal values which permit mast rotation. This automatic camber formation in the main sail 16 then provides a higher lift on the front side of the main sheet 36 as shown and a low drag on the trailing edge in order to provide additional forward directed force on the main sail and mast.

In this manner, the pitch-sensitive variable camber mast operates to adjust the camber of the main sail to shift the lift point of the sail fore and aft as the velocity of the wind decreases in order to increase the lift on the sail in a forward direction which compensates for the decreasing velocity of the wind and thus allows high forward speed for the catamaran craft 10 in variable wind velocities. This is believed to be a significant achievement in water craft main sail design and this design is useable on water craft other than double hull catamaran type vessels and specifically can be employed on single hull sailing craft.

Another aspect of the unique main sail and mast combination is that the combination functions in nearly the identical manner in a down wind usage as in the tacking position as shown in FIG. 22A, which is the preferred main sail embodiment.

The backsloped top 482 is useful under high wind velocities $V_2$ to allow the wind to escape upward and to obtain additional lift and reduce or minimize drag eddies. The mast is tapered to an upward point also in order to eliminate drag eddies.

FIGS. 23 and 23A show the interconnection of the mast 480 with the forward beam 26. A cupped ball 540 is screwed onto the top most end of the mast support rod 350 on the top side of the main beam 26. A compression tube 542 is located between in the interior of the main beam in order to take up the compressive load of the cupped ball being screwed into place. If desired, a hexnut surfacing can be employed to allow additional force. The cupped ball 540 is screwed onto a mast swivel washer 544 which has a hinge wing 546 attached thereto. The base 498 of mast 480 has a matching hinge ring 548 which allows joining of the hinge wings by a hinge pin 550 which is secured in place during the raising of the mast but is removed and tethered by a cord or a chain (not shown) during use of the mast during sailing.

The mast swivel washer is supported on a swivel base 552 which is integrally formed on the upper surface of main beam 26.

The mast base 498 is formed with a convaved portion 554 which is integrally formed on the upper surface of main beam 26.

The mast base 498 is formed with a concaved portion 554 which meets with the outer surface of the cupped ball 540. In order to raise the mast, the cupped ball 540 is unscrewed from the top of the mast support rod 350 and the mast swivel washer 544 is placed over the end of the mast support rod. The cupped ball 540 is then screwed into place and the mast is raised to that the concave portion 554 in FIG. 23 comes to rest over the cupped ball as shown in that figure. The hinge pin 550 is then removed but tethered in a close position. The mast is now free to rotate as explained above on the mast swivel washer 544. The dolphin striker rod 412 is shown held into position by a hexbolt 556 located at the bottom of FIG. 23.

FIG. 26 and enlarged FIG. 26A show another means for achieving the camber in the battens as a possible replacement for the means shown in FIGS. 22A–22D. In this modification, a pair of control cords 558 and 560 are secured to the front edge of a control rod 562 which is positioned within and can be moved by the rotation of the mast 480. The control cords 558 and 560 are then crossed behind a vertical cord guide member 546 and threaded into two hollow battens 566 and 568 and secured at the trailing ends thereof illustrated by numeral 570. When a force F is applied during rotation of mast 480, cable 558 is pulled and thus moves the associated hollow batten in the direction shown by arrow F. The force F would of course be exerted during a low wind velocity whereas in a high wind velocity the mast would be straight along the roll axis of the catamaran hulls and hence no camber would be formed in the battens when mast rotation does not occur.

A modification of the batten camber formation means is shown in FIG. 27 wherein the battens are attached to a bungy cord 572. This detail, FIG. 27, corresponds to the function of FIG. 22B. A cord guide 574 is attached to the stern edge of the mast 480, and a corresponding guide 575 (FIG. 22B) in the bow edge of the mast and provides for the passage of the control cord. The elastic bungy cord 572 circumvents the perimeter of the mast 480 and is held by the guides 576, 578, 580 and 582 molded onto the inside surface of the battens 508 and 510. In operation, under a low wind $V_1$ the mast will automatically rotate to a predetermined position thus stretching the flexible elastic cord 572. This motion forces batten 510 forward and outward and pulls batten 508 backward which expands the depth of the sail with mast 480 rotation. Since similar cords are provided for each of the batten pairs 40–64, 510 and 520–524 shown in FIG. 20, all of the battens will be similarly curved in order to form the camber as shown in FIG. 22B under the low wind velocity $V_1$. Under a high wind velocity $V_2$, the main sail 16 adopts a high aspect form in which a low camber is shown. The cord 572 is then nearly equally spaced between the two battens 508 and 510 as shown in FIG. 22B $V_2$.

MODIFICATIONS OF THE MAIN SAIL

In FIG. 22B the paired battens 508 and 510 are joined at the bow edge by a sail guide 584. In operation the rotation of the mast 480 causes bungy cord 572 to pull batten 508 inwardly and at the same time to cause batten 510 to move toward the port side as shown in FIG. 22B under a low velocity wind condition $V_1$. The bungy cord 572 causes the battens to develop additional camber and particularly for the required to develop in batten 510. Under a higher velocity wind $V_2$ the bungy cord 572 is in a lower tension state as shown.

FIGS. 24, 24A and 24B show various aspects of the operation of the jib airfoil 18 in various wind velocities. FIG. 24 shown the jib airfoil in a furled position at a high wind velocity $V_4$. At a somewhat lower wind velocity $V_3$ a portion of the jib airfoil 18 is unfurled from the jib foil cover 70. At a lower velocity $V_2$, the jib airfoil is allowed to become unfurled by operation of the rotation mechanism contained within the cover 70. When a tail wind at velocity $V_1$ is encountered, the jib airfoil 18 is completely unfurled in its Genoa position illustrated in FIG. 24A and a whisker pole 586 is employed to maintain the Genoa position. When the Genoa jib position is employed, the main sail 16 has a maximum tail wind position such as shown in FIG. 24B. This main sail position is nearly perpendicular to the wind velocity vector $V_1$ of FIG. 24. The main sail 16 cross-section shown in FIG. 24B is that also shown in FIG. 22A, B, C and D for wind velocity $V_1$.

FIGS. 22C and 22D show various forms of main sails which can be utilized with respect to the catamaran craft 10.

FIG. 22C shows a variation of a sail in which the mast 608 is formed with an internal I-beam support wall 610 and sail guide 612. In this form a single batten 614 is employed and thus the main sail 16 is formed from a single sail sheet. The mast 608 can be hollow core 615 for buoyancy. The required camber is formed by maintaining the trailing edge of the sail in a fixed position. The tapered battens employed have their thickest portions near the mast 608 and their thinest portions at the trailing edges 616. A preferred method of manufacture is to ultrasonically weld these tapered battens as illustrated by 614 to the sail cloth. As shown by the bowing of the batten at portion 618, the batten is allowed to move within the opening 620 along the stern edge of the mast 608.

FIG. 22D shows yet another variation of a mast and main sail configuration wherein a mast 620 is formed with a parabolic bow edge 622 and a flat stern edge 624 with the batten pairs 626 and 628 integrally adhered to the edges thereof. The batten 626 and 628 are then adhered to a pair of main sail sheets in the same manner as for FIGS. 22A and 22B. A foamed core 629 can be utilized in mast 620 if desired. As shown in FIGS. 22B and 22D, the batten clip means 525 can be employed wherever paired battens are used.

RUDDER ASSEMBLY

Referring now to FIGS. 29 to 39, the rudder housing 20 is rotatably mounted at the stern end of hull 12 on upper and lower hinges 116 and 118 along a generally vertical line. The rudder 22 is raisable into a first support position **22*a* which is used for beaching the craft 10 and in a second raised position 22*b*** which is the trailering position.

The elbow hinge 632 is angled approximately 10 degrees down from the axis of rudder tube 96 and the turning axis of the housing 20 is 90 degrees to the horizonal plane. This arrangement prevents twisting of the rudder tube 96 which would otherwise occur and would have the effect of decreasing equipment, life, and steering ease. In the solid line, lowered position rudder 22 may be pivoted about the vertical axis in order to steer the craft 10. The movement of the rudder tube and the tiller elbow hinge 632 to the starboard or port directions is controlled by the tiller or cat stick 100 shown in FIG. 1 and 150. The tiller connecting tube 98 shown in FIG. 30 connects between the tiller tube elbow 632 and a mating elbow hinge 634 located on the opposite side and connected to the starboard hull 14 rudder tube 97.

FIG. 29A illustrates by a top plane view the shape of the terminal portion 122 of hull 12 and the continuous curvature of the rudder housing and then tapering off to the sharp stern edge of the rudder 22 in order to minimize drag and water eddies about the rudder. This smooth shaped rudder trailing off to a sharp edge is a significantly different feature than found on the prior art sailing crafts.

Figures 32, 33:
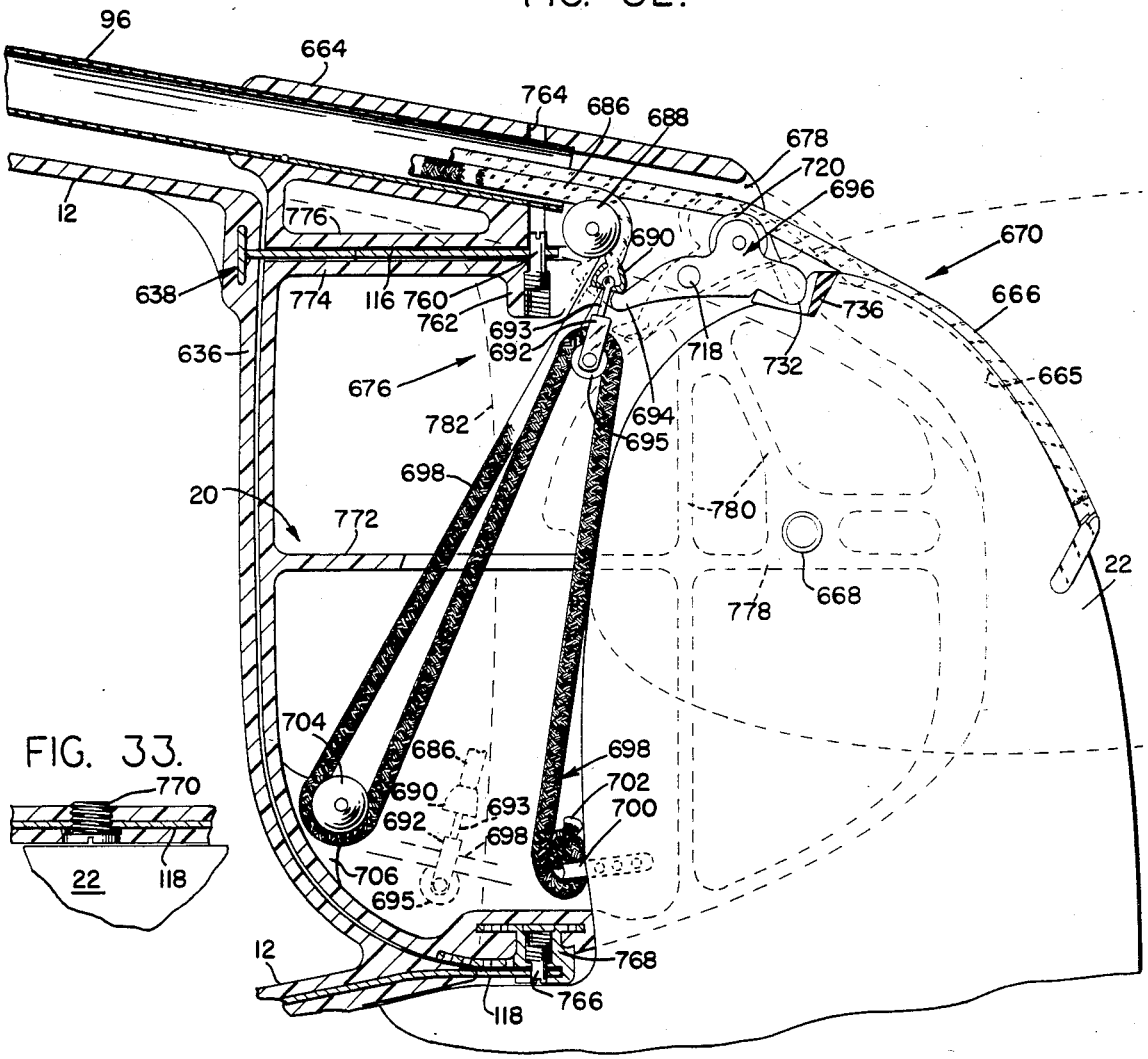
FIG. 32 shows a partial cross-sectional view of the end portion of one of the hulls and the rudder housing showing the rudder in sailing position.
FIG. 33 is a detail view of the rear hull drain plug which is located near the forward edge portion of the rudder which is shown fragmentarily.
Figure 36:
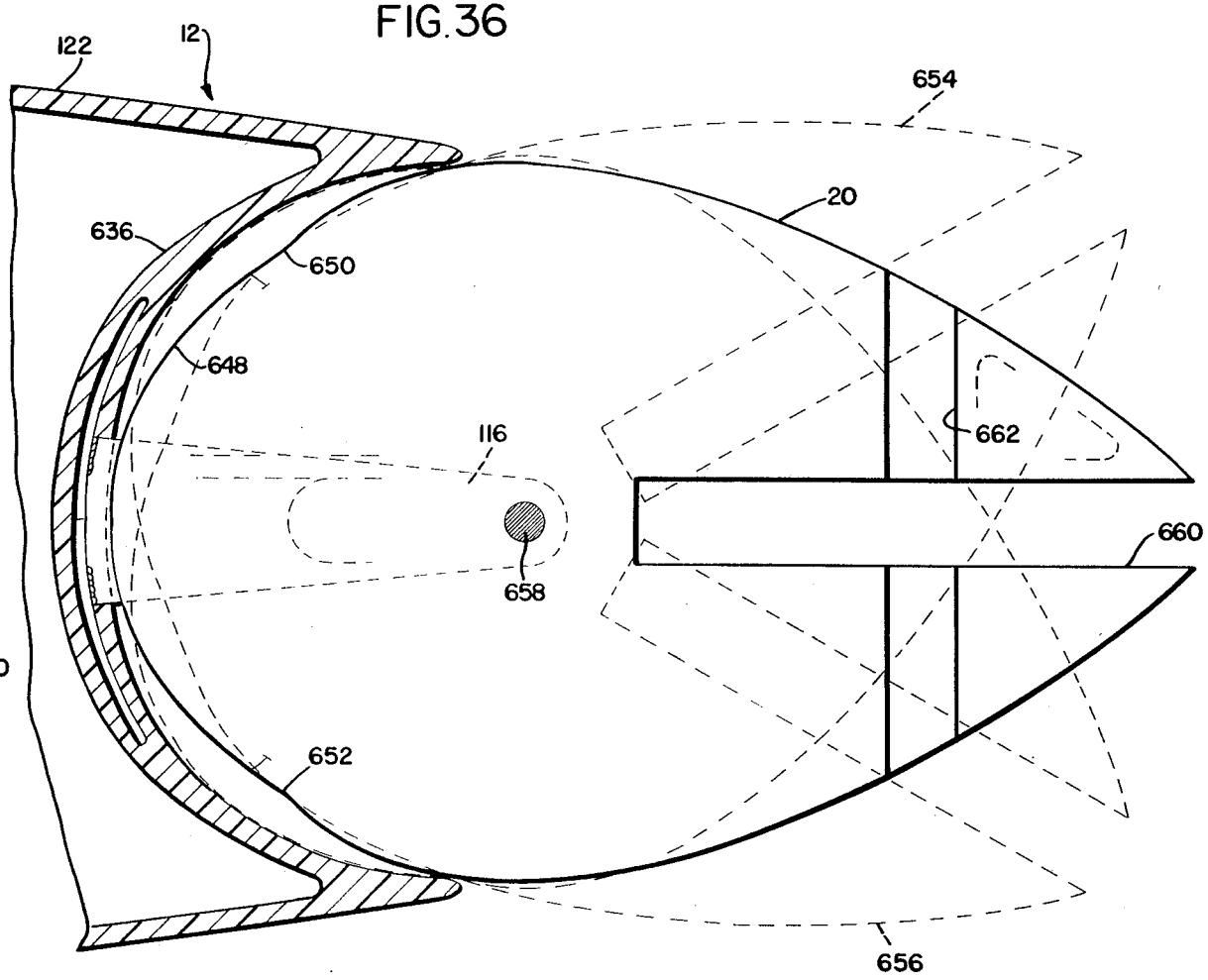
FIG. 36 is a top cross-sectional view of the end portions of one of the hulls showing the rudder housing rotated at different angular positions about the rudder housing hinges.
Figure 36A:
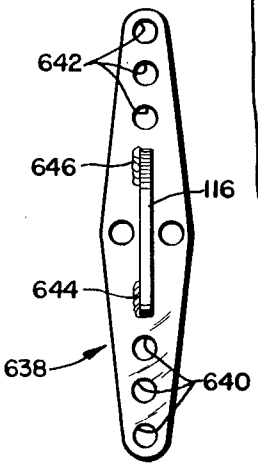
FIG. 36A shows a rear detailed view of the upper rudder hinge prior to its incorporation in the hull end wall.

The hull 12 is formed with an arcuate stern section 636 which can be seen in FIG. 29A and in FIG. 36 in cross-sectional view. This arcuate portion correspondence to stern section wall 140 of hull 14 illustrated in FIG. 4. The upper rudder hinge 116 is integrally molded into the stern wall 636 by means of a hinge base plate 638 which has a series of holes 640 and 642 formed therein in order to allow the fiberglass reinforced polycarbonate to lock thereabout. The hinge ear 116 is welded to the base plate as shown by the weld lines 644 and 646. The rudder housing 20 is rotatable about approximately 70 degrees and is formed with a decreased radius front portion 648 in order to pivot without binding on the arcuate stern wall 636. Thus, the front wall of rudder housing 20 has depressed portions 650 and 652 which come into contact with the stern section wall 636 when the rudder housing has been pivoted to its furthest starboard position as illustrated by dashed lines 654 and its furthest port side pivot position illustrated by dashed lines 656. The rudder housing hinge pin 658 is shown in the sectional view of FIG. 36. The rudder slot 660 and the rudder tube hole 662 can also be seen in FIG. 36. Rudder housing 20 is formed with a tube housing 664 on the top surface thereof for receiving the rudder tube 96 and for allowing passage of a control bungy cord 666 which is passed through and secured at hole 667 located on the upper stern edge of rudder 22. A guide groove 665 is formed in the upper rear edge portion of rudder 22. A rudder securing tube 668, is passed through the walls and internal support structure of rudder housing 20 in order to secure rudder 22 within the rudder slot 660. Due to the length of the rudder slot the force exerted against the side walls of the rudder 22 is absorbed by the entire area represented by the rudder slot in the vertical direction as shown in FIG. 32. Thus, the turning force exerted by the on-rushing water against the rudder 22 is not exerted in a substantial manner against the rudder tube 668.

Figures 29, 29B, 29C, 29D, 29E, 29F, 29G:
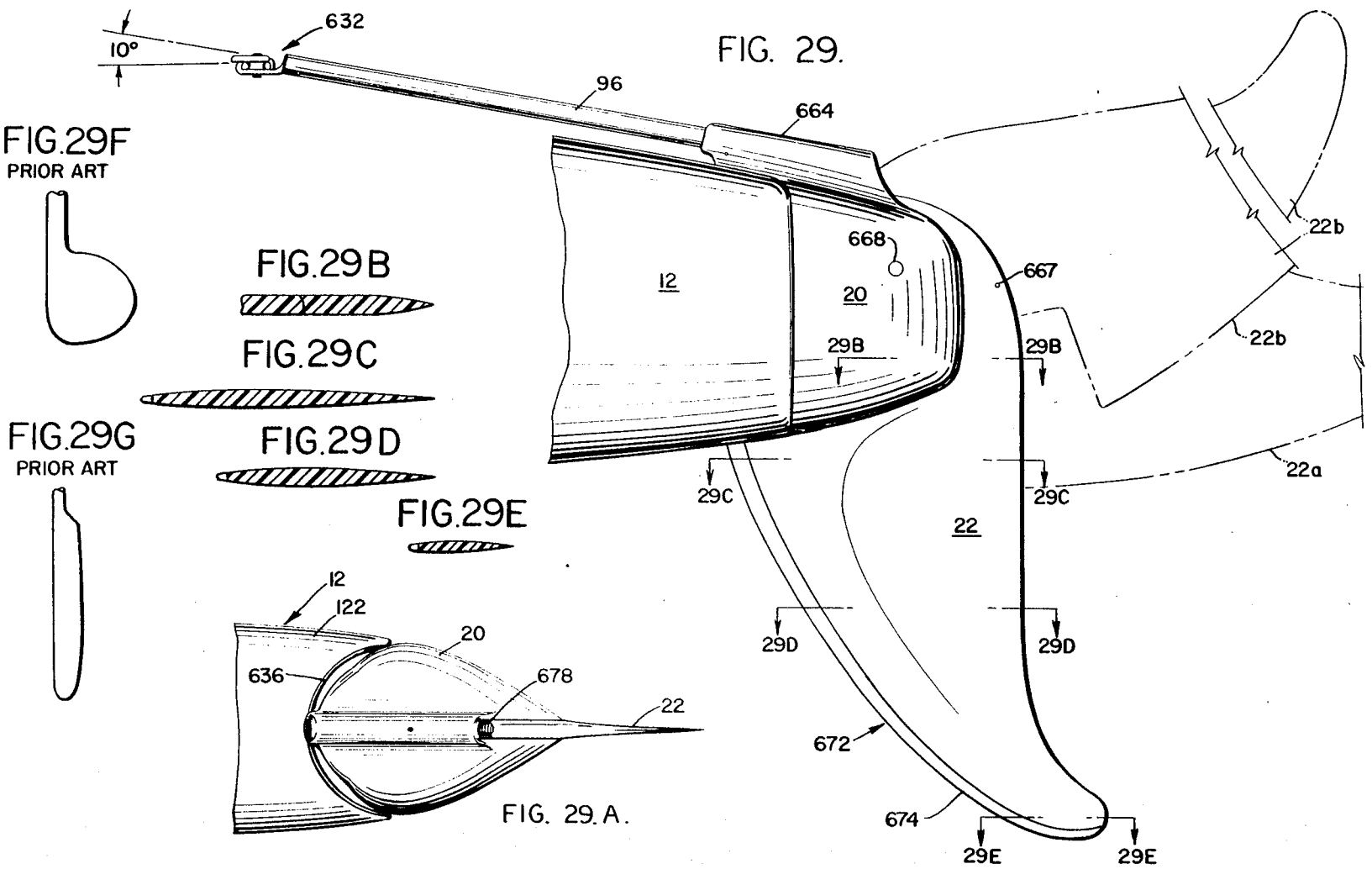
FIG.29F PRIOR ART
FIG.29G PRIOR ART
FIG. 29 is a side elevation schematic view of the end portion of one of the hulls, the rudder housing and the rudder.
FIG. 29B shows a schematic cross-sectional view of the rudder taken at line 29B of FIG. 29.
FIG. 29C shows a schematic cross-sectional view of the rudder taken on line 29C of FIG. 29.
FIG. 29D shows a schematic cross-sectional view of the rudder taken on line 29D of FIG. 29.
FIG. 29E shows a schematic cross-sectional view of the rudder taken on line 29E of FIG. 29.
FIG. 29F and FIG. 29G are side elevation schematic views of prior art rudder shapes which do not have the advantages of the rudder of the present invention.

The shape of rudder 22 is a significant feature of the rudder assembly 670. The 672 rudder is wide as shown in FIG. 29 which provides for ease of steering. The turning power is balanced on both sides of the rudder axis which is located one-third of the distance from the leading edge of the rudder to the stern edge of the rudder. The large rudder area gives low stress steering to produce low water turbulence. Thus it will be appreciated that a significant portion of the rudder extends under the bottom stern end of hull 12. The rudder axis is located at the widest part of the camber of the rudder 22 which is illustrated in the series of FIGS. 29B–29E which are taken on the lines with the same numbers as shown on FIG. 29. The rudder has a sharp trailing edge over its entire length in order to provide low turbulence and minimization of eddy currents. A hard protective strip leading edge 672 is provided to give protection when in the beached position and to protect against contact with rocks or underwater debris. The rudder has a high aspect angle since the bottom edge thereof approaches the horizontal where it has the highest aspect angle. The sloped back stern tip 674 gives greater effective rudder width and drag reduction. The shape of this unique rudder 22 has substantial advantages over conventional rudder shapes such as shown in FIGS. 29F and 29G in that rudder 22 can operate at all vertical angles of contact of hull 12 with the water when hull 14 is riding out of the water under a high wind. Rudder 22 also provides steering when in the trailing position **22*a*** for use in shallow water.

The internal construction of the rudder tube 96 and the tiller elbow hinge 632 and rudder housing 20 and the rudder control means 676 are illustrated in FIGS. 30–36A. The bungy shock cord 666 as shown in FIG. 32 is passed upwardly along the top stern edge of rudder 22 and into stern opening 678 of the rudder tube housing 664. This elastic bungy shock cord 666 is then taken out from the front end of the rudder tube 96 and passed around a securing hook 680 which is riveted to rudder tube 96 by a rivet 682 and which adjustably secures bungy cord 666. This bungy shock cord is then passed back through a second hole formed in a cord guide plug 684 and at this point has been given an identification numeral 686. Bungy cord 686 is taken from the end of the rudder tube 96 and passed over a sheave 688 as shown in FIG. 32. This sheave is supported within the central wall of the rudder housing 20. The end of bungy shock cord 688 supports a cord clamp 690 which is connected to a pulley U-bolt 692 via a connecting rod 693. A pulley 695 is supported by the U-bolt 692. The form of the cord clamp 690 is shown with an upward cam surface and a flat lower surface which engages a trigger end 694 of a trip lever 696 shown in greater detail in FIGS. 34–35B. A control cord 698 is connected to the front top edge portion of rudder 22 by a U-strap 700 where the cord 698 is knotted as shown by knot 702. This control cord is passed over sheave 695 and thence downwardly to a second sheave 704 which is secured on sheave housing ears represented by ear 706 located in the front arcuate section of the rudder housing 20. The control cord 698 is then passed through rudder tube 96 and through the cord guide 684 and around a sheave 708 located in the tiller elbow hinge 632. A cord guide 710 is provided in an upstanding fashion from the lower elbow hinge 712. An upper hinge 714 forms the other one half of the tiller elbow hinge 632 and the two parts are secured one to another through sheave 708 interposed by a hinge pin 716. The control cord 698 then runs along the entire length of the tiller connecting tube 98 and passes into a similar tiller elbow hinge 634 located on the starboard hull 14. The cord 698 permits control of both rudders independently from any position along the tube 98.

The operation of the raising and lowering of the rudder 22 will be described following the description of the trip lever in FIGS. 34–35B. Referring now to these figures, the trip lever 696 pivots about a shaft 718 and has a bungy shock cord sheave 720 located at the upper side thereof held between a pair of support ears 722 and 724 by a shaft 726. The trip lever 696 is held in the position shown by bungy cord 666 exerting a downward force against sheave 720. The trip lever has a rounded heel portion 728 to aid the release of the trip lever which is formed with a bungy cord groove 730 which is aligned with the groove of the top sheave 720. The bungy shock cord 666 rests in the groove of top pulley 720 and passes through the groove 730 when the trip lever is in the tripped position. A pivotal heel support 732 is pivotally secured in a circular groove 734 in the top portion of rudder 22 and has a compressible rubber wedge 736 retained therein by a key hole groove 738 shown in FIG. 34B. As shown in FIG. 34, the pivotal heel support 732 can be compressed backwardly by compression of the rubber wedge 736 at which time the front edge of the heel support 732 contacts the undersurface notch 740 on the bottom side of the trip lever 696. The bifurcated trigger end 694 of the trip lever 696 is shown in FIG. 35B. The construction of the rudder assembly and the operation of the bungy shock cord 666 and the return link thereof 686 and of control cord 698, cooperating with the trip lever 696 and the heel support 732 is such that the rudder 22 will be automatically released from its down steering position as shown in FIG. 29 upon collision of an underwater object such as a sand bar, log or stone and can also be released as desired by the crew by a short tug on the control line 698.

The first operation can be described as follows. Upon collision with an underwater object, the rudder heel support 732 will be forced against the heel portion 728 in order to compress the rubber wedge 736. This will in turn allow the front edge of the heel support 732 to contact the notch 740 on the undersurface of the trip lever 696 whereby the trip lever will be forced upwardly from the rear thereof about the shaft 718 in order to allow the cord 690 to clear the bifurcated trigger end 694 and for the upper edge of rudder 22 to move under the trip lever 696 by action of the bungy cord 666 contracting. The bungy cord 686 will thereafter drop downwardly to the phantom line position illustrated in FIG. 32.

If the crew desires to raise rudder 22 this can be accomplished by providing a sharp pull to control cord 698 which will then drop the cord clamp 690 across the front edge of the trigger end 694 and thus allow the bungy cord 666 to raise the rudder 22. It is possible to pull the control line 698 outwardly away from the tiller connecting tube 98 so that both rudders 22 and 158 are raised simultaneously or to pull the cord in one direction or the other in order to trip the trip lever and raise only one of the rudders such as shown in FIG. 8. The rudder assembly permits the crew to lower the rudder into sailing position by slowly pulling the control line 698 away from the tiller connecting tube 98. This action lowers the pulley 695 from the solid line position in FIG. 32 to the phantom line position. The cord clamp 690 pulls the trigger down, then passes over the trigger end 694 and heel support 732 releasing contact. Reestablishing contact with trip lever 696 comes by releasing the line. The pulling of control cord 698 away from the tiller connecting tube 98 pivots rudder 22 about tube 668 and pulls bungy cord 666 held by hook 680 outwardly and the other end thereof 686 retracts upwardly to engage cord clamp 690 with trigger and 694 when cord is released. Rudders in the floating position 22*a* can still provide steering in very shallow water.

As shown in FIG. 30B, the cord guide 684 is secured within the rudder tube 96 by a fastener pin 742 which passes through a hole 744 formed through both of the elements. A unique tow-in-adjustment means 746 is shown in FIGS. 31 and 31A–31D. This means consists of the tiller connecting tube elbow hinge sheave 714 being formed with a tubular insert portion 748 which has a series of seven holes drilled therein at three different angular positions as shown in FIG. 31B. The tiller connecting tube 98 has a series of three holes drilled therethrough for the passage of a tiller tube bolt 750 which has a hex nut 752 on one end thereof and a hex head 754 on the other end thereof. The holes drilled through the tubular insert 748 are shown in a plane view as dotted line holes 756 in FIG. 31C whereas the holes in the tiller connecting tube 98 are shown as solid line holes 758 with the bolt head 754 of connecting bolt 750 shown as well. The purpose for this adjustment is to allow incremental adjustments in the coaxial positioning of the tube portions 748 within the tiller tube 98 so that the rudder 22 connected by the elbow 632 can be made true to the vertical plane passing through the keel of hull 12 in order to decrease the eddy current turbulence and to decrease the force necessary for steering the catamaran. The arrangement of the interior and exterior holes shown in FIG. 31C is such that no twisting of the tubular portion 748 with respect to the tiller tube 98 occurs. Tow in adjustments of one-eighth inch positions can be made easily.

Referring now to FIG. 32, additional details in the rudder assembly show the upper hinge pin 760 threaded into an internally threaded housing 762 formed within the rudder housing 20 so that the pin can be backed out of the housing spacing and into contact with the hinge 116 by insertion of a scredriver through a hole 764 formed in the upper surface of the rudder tube housing 664. In order to remove the rudder housing 20, the hinge pin can then be turned downwardly into the housing 762 whereby the top hinge becomes cleared. A similar bottom hinge pin 766 is provided in a threaded housing 768 which is integrally molded into the bottom portion of the rudder housing. Bottom hinge ear 118 provides support for the lower rudder housing section. Hinge 118 is integrally molded into the bottom wall of hull 12 and a drain plug 770 is provided therethrough at the leading edge portion of rudder 22 as shown in FIG. 33. Also as shown in FIG. 32, the rudder housing is formed with a number of internal support walls such as wall 772 shown in cross-section and the upper walls 775 and 776 which pass on the upper and lower surfaces of the upper hinge ear 116. Other internal walls are shown in phantom lines and denoted as walls 778 and 780. The stern end of hull 12 is shown as hull edge 782.

FIG. 37 shows a stern end view of rudder housing 20 and rudder 22 in the sailing position.

Figure 38:
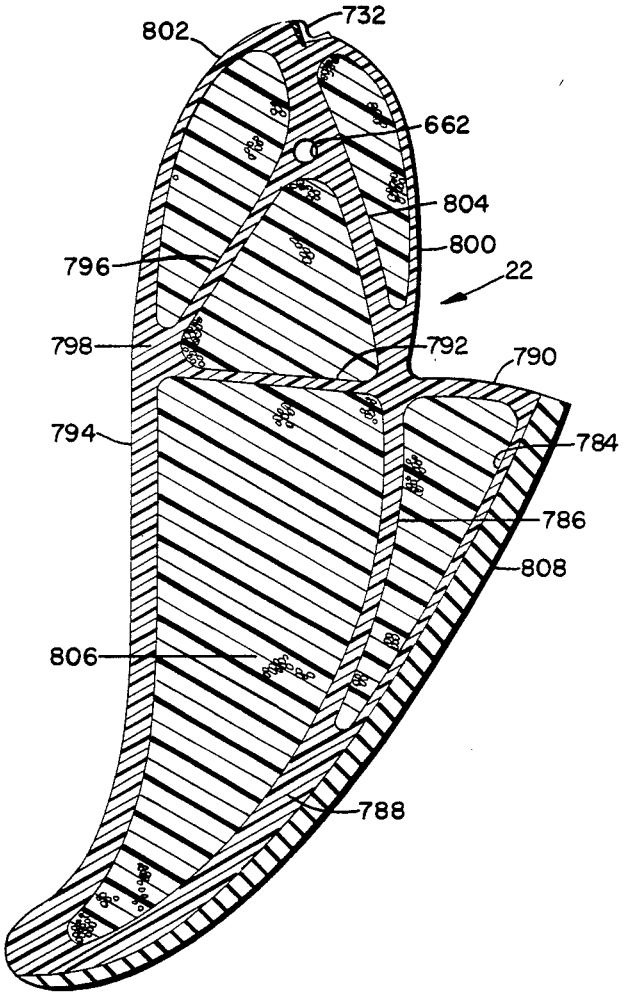
FIG. 38 shows a side cross-sectional detail view of the rudder reinforcing structure.
Figure 39:
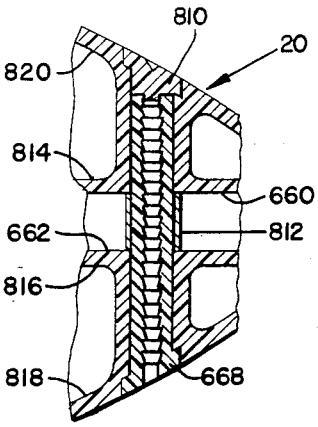
FIG. 39 shows a top fragmentary cross-sectional detail view of the rudder housing and the two part rudder pin.

FIGS. 38 and 39 show the internal skeletal construction details for rudder 22. The body of the rudder is formed with a front fiberglass reinforced composite wall 784 which then is integrally formed with an internal polycarbonate reinforcing wall 786 which is then molded into a single lower but thicker leading edge wall 788 at the lower end thereof. The top front notch wall 790 is integrally connected between the front wall 784 and the internal reinforcing wall 786 and extends therebeyond as an internal support wall 792 which connects to the rear wall 794 which is made uniformly wide due to its thin section which is a sharp stern edge as shown in FIGS. 29B–29E. The arcuate inner reinforcing wall 786 continues upwardly and provides support at its upper end for the pivotal heel support 732 which takes large compressive forces when the rudder 22 encounters an underwater fixed object. Thus, internal reinforcing wall 796 extends from the connection point 798 at the stern edge and is utilized at its upper end to form the rudder tube hole 662 at its upper end. The front top wall 800 and the rear top wall 802 are then formed about the internal A-shaped reinforcing walls 796 and 804. A filled core of a foamed polymer material 806 can be utilized between the various reinforcing and exterior walls. As shown in FIG. 38 the leading edge of the rudder 22 is formed of a hard urethane strip insert 808 as described with respect to FIG. 29. The rudder 22 can be molded in solid polycarbonate.

FIG. 39 shows the details of construction internal to the rudder housing 20 wherein the rudder tube 668 is inserted into tube openings 662 and is then secured into position by a mating bolt 810 which is threaded on its exterior surface and mates with internal threading on the rudder tube 668. An outer sleeve 812 can also be provided for decreasing wear on the rudder about the rudder tube opening 662. The inner and outer walls 814 and 816 and 818 and 820, respectively, which the rudder housing 20 are also seen. The self-locking pin set is pressed together, thus removal is by drilling out.

A similar fiberglass reinforced composite construction is employed for the hulls 12 and 14 and the rudder housing 20 as well as the rudders 22 and 158 and the starboard hull rudder housing and mast.

METHODS OF MANUFACTURING

Hulls 12 and 14 can be produced by several known methods including: (1) Hand lay up of fiberglass bats prewetted with resin or prepared by spray filling with polyester, epoxy resins or polyurethane which offers the advantage of low capital equipment costs and the ability to preform certain parts such as the beam tube pockets, and (2) fiberglass blowing and resin spraying where the reinforcement filament is chopped and blown on a mold core simultaneously with the resin spray-up. Reinforcement members such as a polycarbonate bow, stern and beam pocket elements can also usefully be employed during construction. The hulls can be formed by producing an upper and a lower hull portion which can be lap-seamed together near the water line position. Another production method is to filament wind the hulls with prewetted fiberglass filaments on a core which can be of light weight material and included as an inner layer within the hulls or which can be collapsible for removal after curing of the polyester. It is also possible to employ hollow fiberglass filaments in these three main processes to decrease the final hull weight.

The rudder assembly 670 has reinforcing ribs such as 772, 774, 776, 778, and 780 and members 786, 790, 792, 794, 796, 800, 804, etc. which can be integrally molded of a polycarbonate for strength and then filled with a foamed polyurethane. A polyester gel coat can then be applied as an outersurface.

The mast 480 can be manufactured by preparing an internal mandrel consisting of a central I-beam such as 504 of FIG. 22A and the foam polyurethane core inserts and to then filament wind the mast section. The I-beam is produced by pultruding a fiberglass bundle through a curing mandrel. Hollow fiber construction can also be used for the filament winding of the mast.

In the filament winding steps described above the use of phenolic resins as the binding matrix can provide advantages of lower cost and improved resiliency of the finished product, particularly when using hollow fibers. The hollow fibers provide flotation and weight savings and lower manufacturing costs, high production rates with fewer losses and higher levels of strength to weight ratio.

The surface texture illustrated in FIGS. 6 and 7A–7C can be formed on the prepared hull surface by and injection vacuum molding process which uses an outer mold having the mold pattern formed therein. This pattern is closed spaced to the hull surface and a polyurethane or other polymer is injected into the narrow annular space. The surface texture pattern is computer generated in a plastic mold material to produce about 25,000 diamond-shaped planar areas per square inch [about the density of human scalp hair follicles]. The leading or fore corners of the planar areas are depressed not greater then 10° from the exterior hull surface 108 as shown in FIG. 7C.

The diamond-shaped textured surface of the craft can be produced in a variety of ways. It provides hardness, flexibility, vibration, absorption, toughness, improved appearance, low maintenance, and a mechanically geometric design which cohere with the water surface to allow friction-free molecular movement. The skin surface body can have a solid or foam fill between it and the hull structure it covers. This expanded surface provides a reinforced fiberglass structure providing floatation superior to that of prior art foamed sandwich methods. U.S. Coast Gurard regulations for floatation are met by this construction.

ADVANTAGES

The combined use of the new elements described herein provides a superior sailing craft in performance, quality, cost savings, low maintenance, simplicity of design, ease of handling, safety, comfort, appearance, usefulness, high speed operation, and reliability.

The mechanical advantages here described all provide a more desirable and useful craft for both the experience and the novice sailor. Operation of the craft is easier compared with other craft, due to the combined elements which give it greater stability in all sailing conditions.

Hull;
Length . . . 17 ft. Beam . . . 8 ft.
Total Capacity . . . 3 for racing
Pitch Sensitive Variable Camber Mast . . . 35 ft. height
Drag free rudder and housing with manual and safety release
Abrasion resistant strip on keel and rudder
Low drag skin texture
Storage compartment
Pressure reducing nose
Weight . . . 200 to 250 lbs. [estimated]

Various combinations provide this craft with the ability to hold the noses of both hulls afloat. Under extreme conditions, one hull can be forced under the water surface with no danger of nosing or being forced down by the water movement. Pitch-poling is commonplace with prior art craft. The elements which aid in totally eliminating this danger are the combinations of the nose angle, keel hydroplaning concave attack angle, the properly positioned floatation point, angle of the side walls, and the semi-circular bottom configuration of the hulls. This causes the water pressure to decrease which makes water move faster instead of causing downward forces acting on the craft. Should the draft be blown over on its side by the wind, the mast will float upon the surface with enough floatation to prevent the mast from being forced totally under water. One person can counter balance by his own weight to right the craft with no equipment needed.

Under all sailing conditions, the chance of injury has been eliminated to the greatest extent possible by removing any sharp angled design, hazards, or objects which could cause injury. the use of foam cushions and padded toe lines or foot straps provide maximum comfort. This craft rides high from the surface, providing a drier ride. The ease of steering and main sheet adjustments provide comfortable sailing. The stability of design in the hulls provide a smooth steady and silent motion with no effect by the wave action. A balanced area can be felt which enables an operator to fly one hull without losing his ense of balance or steering control.

Steering is a necessity which greatly affects the ease and comfort of handling a craft. In most conditions, this craft has finger tip control. A power steering effect is built into the design by placing the vertical turning axis back from the bow one-third the total length of the hulls. As the rudder is turned, the front third is acted upon by the water in its path which helps turn part of the rudder. The total length from leading edge to tail is greater with little surface area. This length gives improved turning power due to a lower turning angle which reduces turbulence. A narrow rudder would to be turned at greater angles causing extreme drag. The two rudders in use provide turning power along with the keel. Turning control is substantially improved over prior art craft. So great is controlability that a slalom skier can be pulled with ease.

The high aspect design in the rudder and rudder housing give lower drag ratios. The rudders can be raised or lowered by one person from either side with one control line. When moving through turbulent water, the rudders will not release: however, when struck by underwater obstacles, they will quickly release automatically. This safety feature along with the protective strips on the leading edge saves equipment and provides trouble free sailing.

An important feature of this craft is the new mast and main sail assembly. All dimensions and moving limitations are predetermined and change automatically by the force of the wind. The operator need not be an experienced sailor. The necessary changes are made automatically and instantly according to the exact velocity of the erratic wind in the craft's design.

Because of the mast design, much higher speeds can be obtained. More pull due to the air pressure decrease will be in a forwardly direction instead of the common side pull. The keel works closely here to prevent side drifting thus giving more thrust forward. Higher tacking angles can now be achieved.

Storage, setting up, dismatling, and care for the craft is convenient. Traveling is easier for small engine cars because of the light weight and two part mast which rides out of the way below the boat on the trailer. All raw materials used are not affected by sun light, ozone, or weather. The sail and mast are assembled either on the water surface or on the beach. Two cables are secured along with the mast to the mast ball, then the mast is raised down wind after which the third and final cable is attached. Because of the new quick release hook 234, no pins and rings are lost while rigging. The jib air foil can easily be attached or removed at any time according to need. Because of the high aspect ratio of the main sail, a genoa jib sail combination is provided for low wind or down wind use. The entire craft can be rigged in a few minutes with no great effort needed.

The hulls need never be waxed, only cleaned, because the wax build up would interfere with the surface texture. Dismantling the entire boat is easily accomplished. Only 2 bolts and 2 screws connect each hull. The two bolts are accessable after opening the lid. The rudders can be removed by backing out two screws. One person can fully rig this sailing craft, however, two are recommended. If the hulls or any part become damaged, they can be repaired by conventional means.

The stern end 106 of the keel is positioned at the mid-point of the overall length of the hull and rudder assembly including the stern end of the rudder. This position for the keel, extending forward to near the rounded bottom bow portion is believed to obtain significantly better forward thrust for the hull as well as to obtain better steering stability.

In sailing craft 10 the main sail anchor post 32 is moved more frequently during sailing than in sailing craft having a conventional mast and boom design in order to take full advantage of the superior performance capabilities.

The above descriptions and modifications of the invention are to be understood as illustrative and not limiting with respective to any other modification or embodiment which is covered by the scope hereof as defined by the following claims.

What is claimed and desired to be secured by Letters Patent is:

1. A shroud line cleat comprising first and second cleat shells joined through at least two upstanding side wall portions thereof extending upwardly from the two inner surfaces of each of said shells, a pair of top and bottom teeth sets integrally molded to each of said side wall portions and to each of said inner shell surfaces of each of said first and second cleat shells, openings at opposing ends of said cleat for enabling entry of two shroud lines, at least one of said teeth sets of each pair thereof having the height of the teeth varying across the shell inner surface length thereof, and each of said top and bottom teeth sets adapted to contact two spaced surface areas of each of said shroud lines at diagonal angles with respect to perpendicular planes across said shroud lines and configured to diverge inwardly away from said two side wall portions and adapted to force the shroud lines into contact within said cleat.

2. The shroud line cleat according to claim 1, wherein said openings have corner posts located therein for separating two shroud lines for entry into said cleat.

3. The shroud line cleat according to claim 1, wherein said shells are formed of high density, high impact resistance thermoset polymer and are joined by a series of metal rivets.

4. A sailing craft comprising, in combination, at least two hulls arranged in parallel configuration and separated by a longitudinal plane positioned along the roll axis and having an interconnecting means joining the same, at least one of said hulls having a keel integrally formed therewith and positioned under a portion of the fore two-thirds of said hull, the aft portion of said hull tapering to the stern section of said hull, a rudder assembly contained in the stern section of said hull, a rudder mounted in said assembly for steering said sailing craft and adapted for pivoting into and away from a steering position, said rudder assembly having a single cord control means adapted to selectively move said rudder between the steering position and a trailing position and vice-versa, and a contractable tensioning means connected between said rudder and said rudder assembly for pivoting said rudder from the steering to a trailing position upon operation of said single cord control means, a mast and main sail assembly mounted on said craft, said mast rotatably mounted on said interconnecting means and secured thereon in substantially vertical disposition by cable means, said main sail adapted to be supported in a raised position by said mast and having a series of vertically spaced battens attached thereto, at least one main sail anchor shroud adapted for connecting the trailing corner of said main sail to said interconnecting means, said mast and main sail assembly being pitch-sensitive and adapted to form variable camber adjustments and to form a concave vertical sideways bow therein with respect to the longitudinal plane between said hulls in response to a first, wind force exerted there against and to adopt a high aspect configuration when in the concave bowed shape and adpated to straighten the vertical sideways bow curvature therefrom and form a camber adjustment therein at a second, lower wind velocity and to adopt a low aspect configuration when in straightened shape.

5. A sailing craft comprising, in combination, a water craft having at least one hull having a keel integrally formed therewith and positioned under a portion of the fore two-thirds of said hull, the aft portion of said hull tapering to a stern section, a rudder assembly contained in the stern section of said hull, a rudder mounted in said assembly for steering said sailing craft and adaped to pivoting into and away from a steering position, a mast and main sail assembly mounted on said water craft in a substantially vertical disposition, said mast having a generally vertically disposed main section and a top section having a curvature formed therein toward the stern end of said water craft, said mast rotatably mounted on said water craft at a first pivot point, said mast and mainsail assembly having first and second cable stays attached on either side of said mast at second pivot points positioned on said top curved section to support said mast in a generally vertical position on said water craft, said second pivot points located in a transverse vertical plane spaced in a sternward direction from the transverse vertical plane through said first pivot point, a mainsail adapted to be supported by said mast and having a series of vertically spaced flexible battens integrally attached thereto, said mast and mainsail assembly being pitch-sensitive and adapted to automatically form variable camber adjustments by rotation in response to variable wind velocities about an axis between said first and second pivot points, said assembly adapted to form a concave vertical sideways bow therein between said first and second pivot point with respect to a longitudinal plane passing through the water craft from the fore to aft ends in response to a first high wind velocity exerted there against and to cause a high aspect camber curvature to form automatically in said main sail in a horizontal plane when said assembly is vertically bowed, and said assembly adapted to straighten the concave vertical sideways bow therefrom in response to a second, lower wind velocity and to cause a low aspect curvature to form automatically in said mainsail in a horizontal plane by operation of said flexible battens due to an automatic rotation of said mast in response to the lower wind velocity.

6. A sailing craft comprising, in combination, a water craft having at least one hull with a keel integrally formed therewith and positioned under a portion of the fore two-thirds of said hull, a mast and mainsail assembly mounted on said water craft, said mast rotatably mounted on said water craft and secured thereon in substantially vertical disposition, said mast and main said assembly being pitch-sensitive and adapted to form variable camber adjustments and to form a concave bow therein with respect to the longitudinal plane of said water craft in response to a first, wind force exerted there against and to adopt a high aspect configuration when in the concave bowed shape, a rudder assembly having a rudder housing adapted to be pivotally secured to the stern section of said water craft and having a rudder tube extending therefrom in the bowed direction of said water craft for pivoting said housing with respect to said water craft, a rudder mounted within said housing and adapted to be secured therein in a lowered steering position and adapted to be pivoted into and away from steering position, a single cord control means adapted to selectively move said rudder between the steering position and a trailing position and vice-versa without reciprocation of said rudder tube, and a contractable tensioning means connected between said rudder and said rudder housing for pivoting said rudder from the steering to a trailing position upon operation of said single cord means.

7. A sailing craft comprising, in combination, a water craft having at least one hull, a keel integrally formed with said hull and positioned under a portion of the fore two-thirds thereof, a rudder assembly contained in said stern section of said hull and having a continuous curvature with respect to the taper of said hull stern section, a rudder mounted in said assembly for steering and for pivoting away from a steering position, a mast and main sail assembly mounted on said craft, said mast rotatably mounted on said water craft and secured thereon in a substantially vertical disposition, a surface skin pattern for at least a portion of said hull which is adapted for contact with the water during use of said sailing craft, said skin pattern comprising a series of minute diamond-shape planar surface areas of a density greater than one per square inch separated from one another and positioned with the fore corners thereof depressed inwardly toward said hull.

8. The sailing craft according to claim 7, wherein said diamond-shaped areas have approximately 60° angles in at least two corners thereof.

9. A sailing craft comprising, in combination, at least one hull having a keel integrally formed therewith and positioned under a portion of the fore two-thirds of said hull and the depth of said keel being approximately one-seventh of the vertical dimension of said hull and the aft position of said hull tapering to a stern section, a rudder assembly contained in said stern section of said hull and having a continuous curvature with respect to the taper of said hull stern section, a rudder mounted in said assembly for steering and for pivoting away from a steering position, a mast and mainsail mounted on said craft, said mast rotatably mounted and secured thereon on a substantially vertical disposition, said mast and mainsail assembly being pitch-sensitive and adapted to form variable camber adjustment and to form a concave bow therein with respect to the longitudinal plane of said sailing craft in response to a first wind force exerted there against and to adopt a high aspect configuration when in the concave bowed shape.

10. A sailing craft comprising, in combination, at least one hull having a keel integrally formed therewith, and extending from the bow portion of said hull to approximately the mid-section thereof, a rudder assembly contained in the stern section of said hull comprising a rudder housing adapted to be pivotally secured to the stern section of said sailing craft and having a rudder tube extending therefrom in the bow direction of said water craft for pivoting said housing with respect to said water craft, a rudder mounted within said housing and adapted to be secured therein in a lowered steering position and adapted to be pivoted into and away from the steering position, said rudder housing and said rudder forming an assembly having a continuous curvature with respect to the taper of the stern section of said hull, whereby water turbulence is reduced, a mast and mainsail assembly mounted on said craft, and said mast rotatably mounted on said sailing craft in a substantially vertical disposition.

11. A sailing craft comprising, in combination, at least one hull having a keel integrally formed therewith, said hull having a V-shaped bow in the horizontal plane above the water line and a tapered stern section, said hull further comprising substantially vertical side walls integrally connected to a semi-circular bottom portion extending from the bow end of said keel through the stern section of said hull, said keel having a depth of approximately one-seventh of the vertical dimension of said hull, a rudder assembly having a rudder housing adapted to be pivotally secured to the stern section of said sailing craft and having a rudder tube extending therefrom in the bow direction of said sailing craft for pivoting said housing with respect to said sailing craft, a rudder mounted within said housing and adapted to be secured therein in a lowered steering position and adapted to be pivoted into and away from the steering position, said rudder housing and said rudder forming an assembly having a continuous curvature with respect to the taper of the stern section of said hull whereby water turbulence is reduced, a mast and mainsail assembly mounted on said water craft, said mast rotatably mounted on said water craft in a substantially vertical disposition.

* * * * *